US007214078B2

(12) United States Patent
Fukatsu

(10) Patent No.: US 7,214,078 B2
(45) Date of Patent: May 8, 2007

(54) CONNECTOR AND CONNECTOR ASSEMBLY

(75) Inventor: Yukihiro Fukatsu, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/542,719

(22) Filed: Oct. 4, 2006

(65) Prior Publication Data

US 2007/0026709 A1 Feb. 1, 2007

Related U.S. Application Data

(62) Division of application No. 11/258,351, filed on Oct. 24, 2005.

(30) Foreign Application Priority Data

Oct. 22, 2004 (JP) ..... 2004-308765
Oct. 22, 2004 (JP) ..... 2004-308766

(51) Int. Cl.
*H01R 13/62* (2006.01)

(52) U.S. Cl. ..... 439/157

(58) Field of Classification Search ..... 439/157, 439/593, 152–160, 140, 147
See application file for complete search history.

(56) References Cited

U.S. PATENT DOCUMENTS 5,269,696 A * 12/1993 Okada et al. ..... 439/140
5,373,419 A * 12/1994 Wright ..... 361/755
5,453,018 A * 9/1995 Ito et al. ..... 439/157
5,474,461 A * 12/1995 Saito et al. ..... 439/157
5,611,703 A * 3/1997 Okamoto et al. ..... 439/157
5,823,809 A * 10/1998 Wakata ..... 439/157
5,848,908 A * 12/1998 Katsuma ..... 439/157
6,183,278 B1 * 2/2001 Hirasawa et al. ..... 439/157
6,193,531 B1 * 2/2001 Ito et al. ..... 439/157
6,745,911 B1 * 6/2004 Maestranzi ..... 213/75 R
7,070,438 B2 * 7/2006 Dillon ..... 439/347

* cited by examiner

*Primary Examiner*—J. F. Duverne
(74) *Attorney, Agent, or Firm*—Gerald E. Hespos; Anthony J. Casella

(57) ABSTRACT

A return preventing portion flexible locking piece (20) and return preventing portion (52) for preventing a lever (40) from returning from a standby position to a mount position and a locking means flexible locking piece (20) and lock arm (47) for locking the lever (40) at a connection position are provided. The flexible locking piece (20) return preventing means, locking means of a first housing (10) one member is engaged with the lock arm (47) of the lever (40) (other member), whereby the lever (40) is locked at the connection position. The shape of the first housing (10) can be simplified since it is not necessary to provide the first housing (10) with a locking means for exclusive use in addition to the flexible locking piece (20).

5 Claims, 23 Drawing Sheets

CONNECTOR AND CONNECTOR ASSEMBLY

This application is a divisional of U.S. patent application Ser. No. 11/258,351, filed Oct. 24, 2005.

BACKGROUND OF THE INVENTION

1. Field of the Invention

The invention relates to a connector with a movable member to facilitate connection with a mating connector.

2. Description of the Related Art

U.S. Pat. No. 5,611,703 discloses a connector with a lever mounted on a first housing. The lever can be held temporarily at a standby position so that cam followers of a second housing can enter cam grooves of the lever. The housings are connected by displacing the lever to a connection position. The connector includes means for temporarily holding the lever at the standby position, a return preventing means for preventing the lever from returning from the standby position to the mount position, and a locking means for locking the lever at the connection position.

The means for preventing the lever from returning from the standby position to the mount position and the locking means for locking the lever at the connection position are provided separately on the prior art lever-type connector. Thus, the housings and the lever have complicated shapes.

Lever-type connectors generally have a substantially U-shaped lever with two arms that mount to the housing and a connecting portion that extends between the arms. Operational efficiency can be improved by enlarging an operable portion of the lever taking in the thickness of the housing. However, this enlarges the entire lever-type connector.

Some lever-type connectors have been miniaturized by providing a substantially plate-shaped lever that extends only along an upper surface of the first housing. The plate-shaped lever then can be displaced along the upper surface of the first housing. However, the operable portion of the plate-shaped lever must be made thicker because it is difficult to manipulate an operable portion that is as thin as the remainder of the plate-shaped lever.

In the lever-type connector in which the plate-shaped lever is placed on the upper surface of the housing, the depth and width of the lever-type connector become smaller as the overlapping area of the lever and the housing increases. However, if the thicker operable portion is placed on the upper surface of the housing, the height of the lever-type connector increases.

The present invention was developed in view of the above problem and an object thereof is to simplify the shape of a connector and/or to miniaturize it.

SUMMARY OF THE INVENTION

The invention relates to a connector with a housing and a movable member mountable on the housing. The movable member is configured to display a cam action together with cam follower of a mating housing. More particularly, the cam follower can enter a cam groove of the movable member after the movable member is displaced from a mount position to a standby position. The housing then can be connected with the mating housing by displacing the movable member from the standby position to a connection position. A return preventing means is provided for preventing the movable member from returning from the standby position towards the mount position, and a locking means is provided for holding the movable member substantially at the connection position. The return preventing means is on one of the housing and the movable member is engageable with the locking means on the other of the housing and the movable member. Thus, it is not necessary to provide the one member with a locking means for exclusive use in addition to the return preventing means. Accordingly, the shape of the connector can be simplified.

The return preventing means preferably comprises a flexible locking piece that can be deformed resiliently to disengage from the locking means.

The mating housing preferably is disposed to contact the flexible locking finger or other such return preventing means when the housing is connected with the mating housing. The contact between the mating housing and flexible locking piece preferably prevents the flexible locking piece from displacing in a direction to disengage from the locking means. Thus, a reliable locking function is achieved.

The connector may further comprise a connection preventing means, such as a resiliently deformable resilient locking piece, to prevent a displacement of the movable member from the standby position to the connection position.

The resilient locking piece preferably can be deformed resiliently by a canceling portion of the mating housing to cancel the displacement prevented state of the movable member by the resilient locking piece as the cam follower enters the cam groove.

The movable member preferably is substantially plate-shaped.

The housing preferably has a terminal accommodating portion for accommodating at least one terminal fitting and a substantially tubular sealing tower for accommodating a resilient plug mounted on the rear of the terminal fitting. The sealing tower is shorter than the terminal accommodating portion. The movable member is substantially plate-shaped and extends substantially along only one surface of the housing, and has an operable portion. The sealing tower is shifted from the terminal accommodating portion so that the center of axis thereof is offset from the middle of the terminal accommodating portion. The operable portion is accommodated in an accommodation space defined substantially adjacent the sealing tower by an offset between the respective surfaces of the terminal accommodating portion and the sealing tower.

The operable portion preferably is thicker than other parts and shaped to be placed on the respective surface of the housing in the process of displacing the movable member.

The thickness of an upper end area of the sealing tower facing the accommodation space preferably is thinner than other areas. Thus, the position of the operable portion can be lowered to realize a further reduction in the height of the entire lever-type connector.

The operable portion preferably is substantially flush with or inward of the outer surface of the housing when the movable member is at the connection position. Thus, external matter is not likely to interfere with the operable portion from below and will not detach the lever from the housing.

The invention also relates to a connector assembly comprising the above-described connector and a mating connector connectable therewith.

These and other features of the invention will be more apparent upon reading the following detailed description of preferred embodiments and accompanying drawings. Even though embodiments are described separately, features thereof may be combined to additional embodiments.

DETAILED DESCRIPTION OF THE PREFERRED EMBODIMENTS

Figure 1:
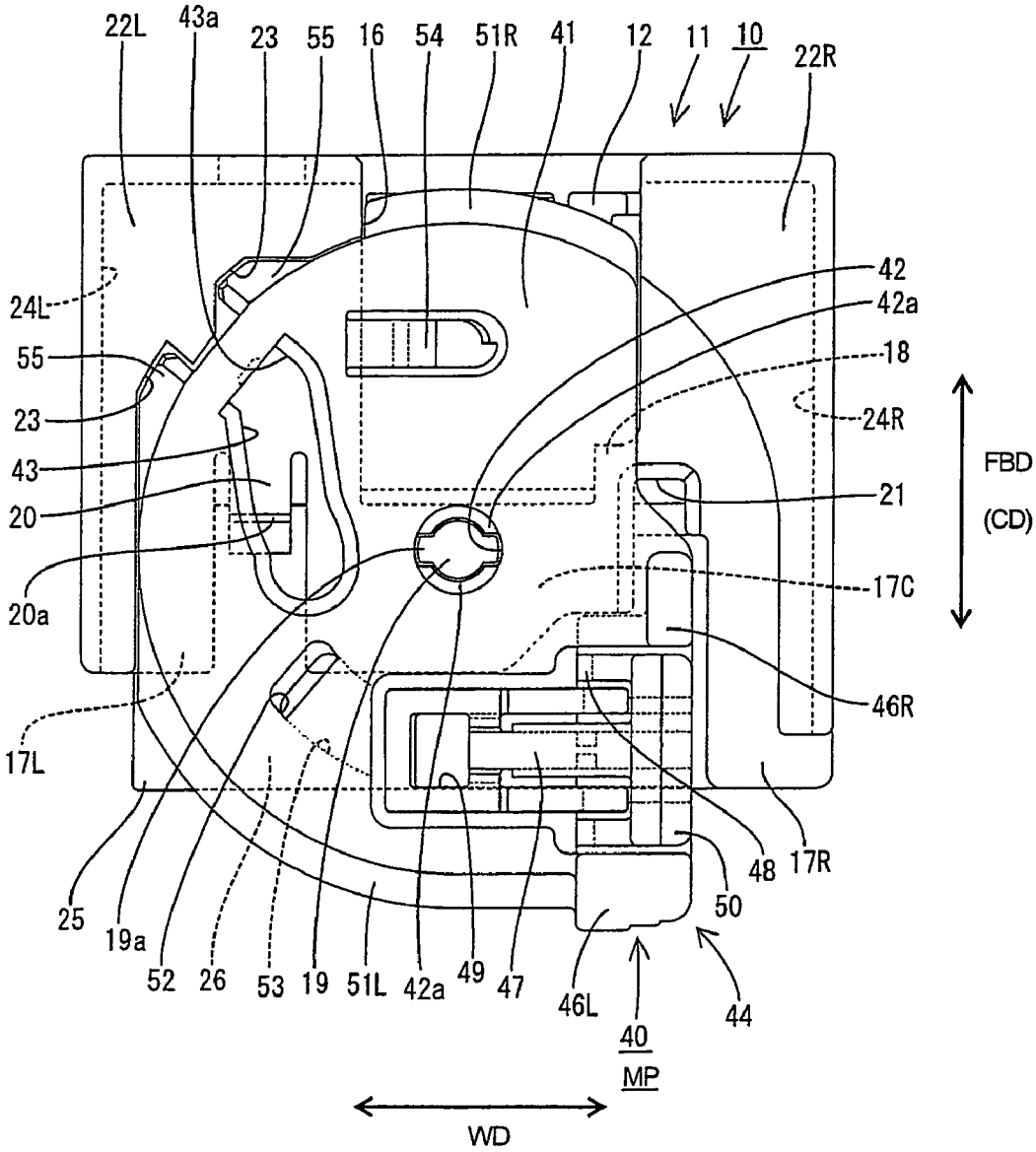
FIG. 1 is a plan view of a first housing with a lever at a mount position.

A connector according to the invention is described with reference to FIGS. 1 to 25. The connector has a first housing 10 and a second housing 60 that can be connected with and separated from each other by a movable member. Ends of the housings 10/60 to be connected with the other are referred to as the front.

The first housing 10 is made e.g. of a synthetic resin and is a flat generally rectangular block that is a shorter along a height direction HD than along forward and backward directions FBD and transverse direction TD. The first housing 10 has a terminal accommodating portion 11 and a seal tower 25.

The terminal accommodating portion 11 has a wide rectangular main portion 12 and a tubular fitting 13 that surrounds the main portion 12. A forwardly open fitting recess 14 is formed between the outer periphery of the main portion 12 and the inner periphery of the tubular fitting 13. Cavities 15 are formed in a substantially transverse row in the main portion 12.

An upper wall 13W of the tubular fitting 13 has a substantially rectangular notch 16 that extends back from a middle part of the front edge. A substantially rectangular receiving portion 18 projects at the rear right corner of the notch 16 and is continuous with the right surface of the notch 16 via quarter-circular arc. A center pedestal 17C is formed behind the notch 16 at the front end of the upper surface of the seal tower 25 at substantially the same height as and substantially flush with the upper wall 13W of the tubular fitting 13. Similarly, left and right pedestals 17L and 17R are formed at the opposite left and right sides of the center pedestal 17C at the front end of the upper surface of the seal tower 25. The left and right pedestals 17L and 17R are at substantially the same height as and substantially flush with the upper wall 13W of the tubular fitting 13. Rear ends of the center and left pedestals 17C and 17L are at substantially the same position. The rear end of the right pedestal 17R is behind the rear ends of the center and left pedestals 17C and 17L, i.e. at substantially the same position as the rear end of the seal tower 25.

A substantially cylindrical support shaft 19 projects substantially in the vertical direction VD from the upper surface of the center pedestal 17C. Retaining projections 19*a* project transversely from the upper end of the support shaft 19. A flexible locking piece 20 is formed between the center and left pedestals 17C and 17L and at the left side of the support shaft 19. The flexible locking piece 20 cantilevers back along the forward and backward directions FBD from the rear end of the upper wall 13W of the tubular fitting 13 and is resiliently deformable to incline up and down with the front end as a support. A lock projection 20*a* is formed on the upper surface of the rear end of the flexible locking piece 20. On the other hand, an escaping recess 21 is formed in the upper surface of the upper wall 13W of the tubular fitting 13 between the center and right pedestals 17C and 17R and at the right side of the support shaft 19. The escaping recess 21 communicates with the fitting recess 14 and with the accommodation space 26. The escaping recess 21, the support shaft 19 and the flexible locking piece 20 are arranged substantially transversely along a direction substantially normal to the connecting direction CD of the two housings 10, 60.

Left and right plate-shaped pressing portions 22R, 22L are provided above the upper wall 13W of the tubular fitting 13. The pressing portions 22R, 22L are substantially parallel with the upper wall 13W of the tubular fitting 13.

The right pressing portion 22R is narrow and long along forward and backward directions FBD, and extends from the right edge of the notch 16 to the right edge of the tubular fitting 13. The right pressing portion 22R is continuous with the upper wall 13W of the tubular fitting 13 at its front and right edges. Additionally, the right pressing portion 22R spans an area extending from the front end of the tubular fitting 13 to a position slightly before the rear end of the right pedestal 17R. The left side of the right pressing portion 22R has an arcuate edge 22Ra and a substantially straight edge 22Rb. The arcuate edge 22Ra is substantially concentric with the support shaft 19. The straight edge 22Rb is smoothly continuous with the arcuate edge 22Ra and extends substantially along forward and backward directions FBD to the rear end.

The left pressing portion 22L is narrow and long along forward and backward directions FBD, but is slightly wider than the right pressing portion 22R. The left pressing portion 22L is in an area extending from the left edge of the notch 16 to the left edge of the tubular fitting 13, and is continuous with the upper wall 13W of the tubular fitting 13 at its front and left edges. The left pressing portion 22L extends from the front end of the tubular fitting 13 to the rear end of the left pedestal 17L. An arcuate edge 22La and a substantially straight edge 22Lb extend along the right edge of the left pressing portion 22L. The arcuate edge 22La is substantially concentric with the support shaft 19. The substantially straight edge 22Lb is smoothly continuous with the arcuate edge 22La and extends along forward and backward directions FBD to the rear end. The arcuate edge portion 22La is formed with two recesses 23.

A right guide groove 24R is formed between the right pressing portion 22R and the upper wall 13W of the tubular fitting 13. The right guide groove 24R is open at the left and rear sides and extends towards the support shaft 19. On the other hand, a left guide groove 24L is formed between the left pressing portion 22L and the upper wall 13W of the tubular fitting 13. The left guide groove 24L is open at the right and rear sides and extends towards the support shaft 19.

The seal tower 25 extends back from the rear end of the terminal accommodating portion 11, and is shorter than the terminal accommodating portion 11 and the tubular fitting 13. The seal tower 25 has three cylinders 25*a* arranged transversely at the substantially same height as and in conformity with the respective cavities 15. The height of the centers of the axes of the respective cylinders 25*a* along the height direction HD is lower than the center position of the terminal accommodating portion 11 and the tubular fitting 13 with respect to the height direction HD. By shifting the seal tower 25 down relative to the terminal accommodating portion 11, the bottom end of the seal tower 25 is substantially at the same height as the bottom surface of the terminal accommodating portion 11 and the upper end of the seal tower 25 is lower than the upper surfaces of the terminal accommodating portion 11 and the tubular fitting 13. The height difference between the terminal accommodating portion 11 and the seal tower 25 forms the accommodation space 26 that is open at the upper, left, right and rear sides above the seal tower 25.

Each female terminal fitting 30 is narrow and long in forward and backward directions FBD. A substantially rectangular tube 31 is formed at the front of each female terminal fitting 30 and a wire connecting portion 32 is formed at the rear. The wire connecting portion 32 is an open barrel configured for crimped, bent or folded connection with a wire 33 and the front end of a tubular resilient rubber plug 34 that is fit hermetically on the wire 33. The female terminal fitting 30 is inserted into the cavity 15 from behind and is secured by a lock 15*a*. A large diameter portion 34*a* of the resilient plug 34 is formed behind the wire connecting portion 32 and is held hermetically in contact with the inner peripheral surface of the seal tower 25. A retainer 35 is mounted on the main portion 12 of the first housing 10 from the front, and a resilient rubber seal ring 36 is mounted on the rear end of the outer peripheral surface of the main portion 12. The retainer 35 prevents the seal ring 36 from coming off forward.

The lever 40 is made e.g. of a synthetic resin, and is substantially plate-shaped. The forward and backward directions FBD and the transverse direction TD of the lever 40 refer to a state where the lever 40 is held on the first housing 10 at the connection position CP where the housings 10, 60 are substantially connected.

The lever 40 includes main body 41 that is substantially circular in plan view, but has a comb-shaped notch in a rear of a substantially circular peripheral area. A substantially round bearing hole 42 vertically penetrates a substantially center of the main body 41, and left and right arcuate retaining edges 42*a* bulge in from the inner circumferential edge of the bearing hole 42. A cam groove 43 is formed before the bearing hole 42 of the main body 41 and is aligned oblique to both the circumferential and radial directions. An entrance 43*a* of the cam groove 43 opens at the outer peripheral edge of the main body 41 at a position slightly shifted to the right from the front end.

An operable portion 44 is formed at the left-half area of the rear end of the main body 41. The operable portion 44 has a support 45 that bulges down from the rear edge of the main body 41. Left and right finger placing portions 46L, 46R project up from the left and right ends of the support 45 to a position above the main body 41. The operable portion 44 also has a lock arm 47.

The lock arm 47 is a plate with substantially the same thickness as the lever main body 41 and is located at substantially the substantially same height as the lever main body 41. The lock arm 47 is substantially rectangular in plan view and is long along forward and backward directions FBD. A leg 48 supports the lock arm 47 on the upper surface of the support 45 at a position slightly before the rear end of the lock arm 47. Thus, the lock arm 47 can undergo a seesaw-like resilient displacement to take a forward inclined posture or a backward inclined posture with the leg 48 as a support. A substantially rectangular lock hole 49 penetrates the front end of the lock arm 47, and a finger contact 50 is at the rear end of the lock arm 47. The lock arm 47 is above the support 45 and between the finger placing portions 46L, 46R.

Left and right bulges 51L, 51R bulge radially out substantially concentrically with the main body 41 from an area of the main body 41 except the rear edge. The bulges 51L, 51R are about half as thick as the main body 41, and the lower surfaces of the bulges 51L, 51R are continuous with and substantially flush with the lower surface of the main body 41. Accordingly, the upper surfaces of the bulges 51L, 51R are lower than the upper surface of the main body 41 to define steps. The left bulge 51L extends from the left finger placing portion 46L to the front end of the main body 41, and the front edge of the left bulge 51L extends substantially straight along the transverse direction TD to be substantially tangent to the outer circumference of the main body 41. On the other hand, the right bulge 51R extends from the rear end of the main body 41 to a position slightly before the bearing hole 42 and behind the front end of the main body 41. A dimension of the right bulge 51R along forward and backward directions FBD is approximately equal to the width of the notch 16 of the first housing 10. Two guide projections 55 are formed on the outer peripheral edge of the main body 41 before the right bulge 51R and project radially out from the opposite sides of the entrance 43*a* of the cam groove 43. The guide projections 55 have the substantially same thickness as the bulges 51L, 51R and are substantially continuous with and substantially flush with the lower surface of the main body 41.

A return preventing portion 52 is formed on the main body 41 before the lock arm 47. The return preventing portion 52 substantially vertically penetrates the lever main body 41 and is long and narrow substantially along a radial direction centered on the bearing hole 42. A distance of the return preventing portion 52 from the bearing hole 42 is substantially equal to a distance from the support shaft 19 to the lock hole 49. A substantially arcuate escaping groove 53 is formed in the lower surface of the main body 41 and extends from the return preventing portion 52 to the lock arm 47.

A long narrow resilient locking piece 54 is formed at the right side of the bearing hole 42 in the main body 41. The resilient locking piece 54 is cantilevered rearwardly on the main body 41 and a rear portion of the resilient locking piece 54 is resiliently displaceable substantially up and down with the front end as a support. A rear portion of the resilient locking piece 54 projects below the main body 41.

The second housing 60 is made e.g. of a synthetic resin and is an integral or unitary assembly of a wide block-shaped main body 61 and a substantially rectangular tubular receptacle 62 that projects forward from the main body 61. Male terminal fittings 63 are inserted into the housing main body 61 from behind to be locked by respective locking portions, and tabs 63*a* at the front ends of the male terminal fittings 63 project forward in the receptacle 62. A cam follower 64 is formed on the outer surface of the upper wall of the receptacle 62 substantially in the widthwise center and near the front end of the receptacle 62. The cam follower 64 is substantially round and projects out with its center axis oriented substantially in a vertical direction VD. Left and right canceling ribs 65 project up from the outer surface of the upper wall of the receptacle 62 at the opposite left and right sides of the cam follower 64. The left and right canceling ribs 65 extend substantially straight along forward and backward directions FBD and parallel to the connecting direction CD with the first housing 10.

The lever 40 is aligned to the first housing 10 so that the right bulge 51R is at the front end. The lever 40 then is brought closer to the first housing 10 from above. Then, as shown in FIG. 1, the lever main body 41 is fit into a space between the left and right pressing portions 22R, 22L and the right bulge 51R is fit into the notch 16. Additionally, the guide projections 55 are fit into the recesses 23 and the bearing hole 42 is engaged with the support shaft 19 by passing the retaining projections 19*a* of the support shaft 19 through clearances between the retaining edges 42*a* of the bearing hole 42. The resulting position is the mount position MP of the lever 40. In this state, the flexible locking piece 20 is deformed resiliently down by the lower surface of the main body 41, and a substantially right half of the operable portion 44 is in the accommodation space 26, whereas a substantially left half of the operable portion 44 projects back from the rear end of the first housing 10. The lever main body 41 is placed on the outer surfaces of the upper wall 13W of the tubular fitting 13, the first left pedestal 17L, and the center pedestal 17C, but is not placed on the upper surface of the right pedestal 17R.

Figure 2:
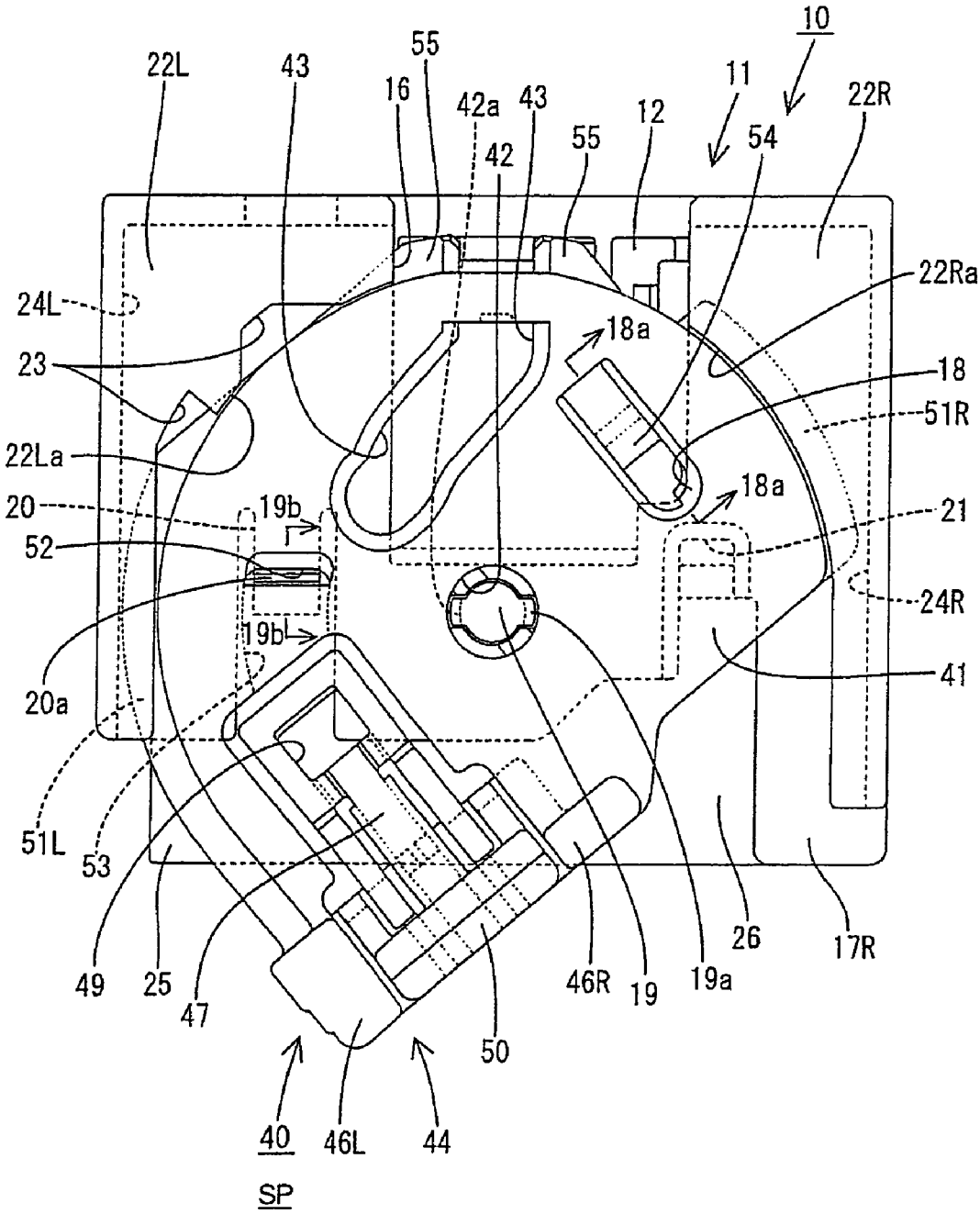
FIG. 2 is a plan view of the first housing with the lever at a standby position.
Figure 18A:
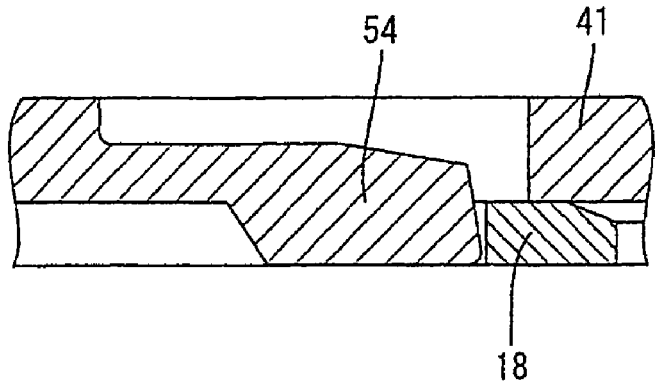
FIG. 18(*a*) is a section along 18*a*—18*a* of FIG. 2 and FIG. 18(*b*) is a section along 18*b*—18*b* of FIG. 4.
Figure 18B:
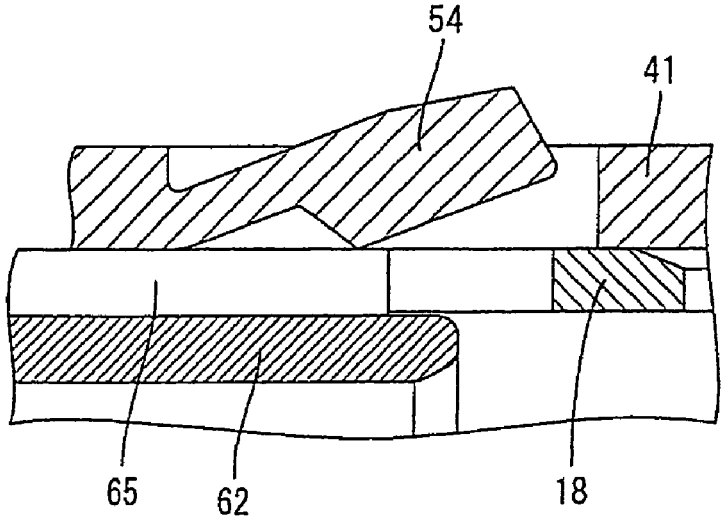
Figure 19A:
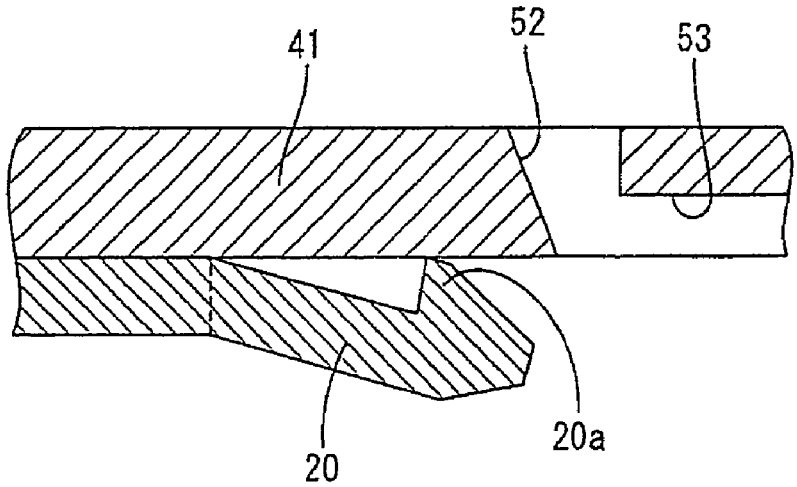
FIG. 19(*a*) is a section showing a state where a flexible locking piece is deformed in the process of displacing the lever from the mount position to the standby position and FIG. 19(*b*) is a section along E—E of FIG. 2.
Figure 19B:
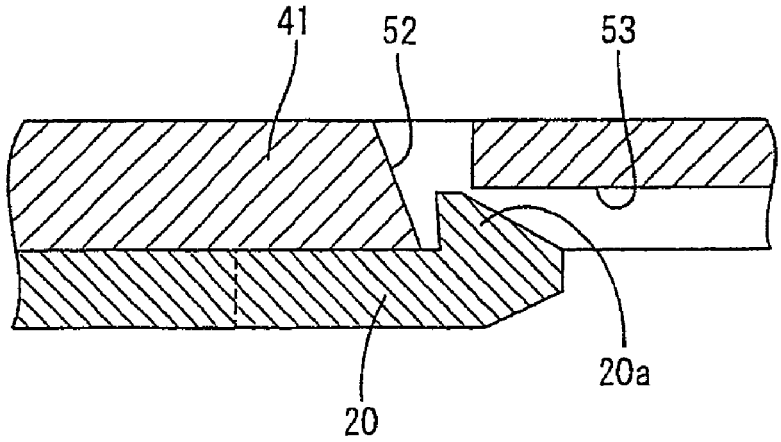

In this state, the left finger portion 46 of the operable portion 44 can be pushed to the left e.g. by a finger. Thus, the lever 40 is rotated clockwise by about 45° around the support shaft 19 to the standby position SP. In the process of rotation, the outer circumferential surface of the main body 41 slides substantially along the left and right arcuate edges 22La, 22Ra. The main body 41 is placed on the outer surfaces of the upper wall 13W of the tubular fitting 13, the left pedestal 17L and the center pedestal 17C, and also on the upper surface of the right pedestal 17R. Additionally, the flexible locking piece 20 slides substantially in contact with the lower surface of the main body 41 while being resiliently deformed down, as shown in FIG. 19(*a*). When the lever 40 reaches the standby position SP, the return preventing portion 52 of the lever 40 engages the lock projection 20*a* of the resiliently restored flexible locking piece 20 in the counterclockwise returning direction, as, shown in FIGS. 2 and 19(B), and the lever 40 at the standby position SP is prevented from returning counterclockwise toward the mount position MP relative to the first housing 10. At the standby position SP, the extending end of the resilient locking piece 54 engages the receiving portion 18 of the first housing 10 in the clockwise direction, as shown in FIGS. 2 and 18(*a*), to prevent the lever 40 at the standby position SP from rotating clockwise towards the connection position CP relative to the first housing 10. In this way, the lever 40 is held at the standby position SP and is prevented from rotating in both forward and reverse directions.

With the lever 40 at the standby position SP, a front part of the operable portion 44 is in the accommodation space 26 and a rear part of the operable portion 44 projects back from the rear end surface of the first housing 10, as shown in FIG. 2. Further, the retaining edges 42*a* of the bearing hole 42 engage the retaining projections 19*a* of the support shaft 19 from below, and the right and left bulges 51R, 51L fit respectively into the right and left guide grooves 24R, 24L. Thus, the pressing portions 22R, 22L engage the upper surfaces of the bulges 51R, 51L. Upward displacement of the lever 40 relative to the first housing 10 along the axis of rotation of the lever 40 is prevented by these engagements. Further, there comes a state where the entrance 43*a* of the cam groove 43 faces forward towards the notch 16 so that the cam follower 64 can enter the cam groove 43 from the front.

Figure 4:
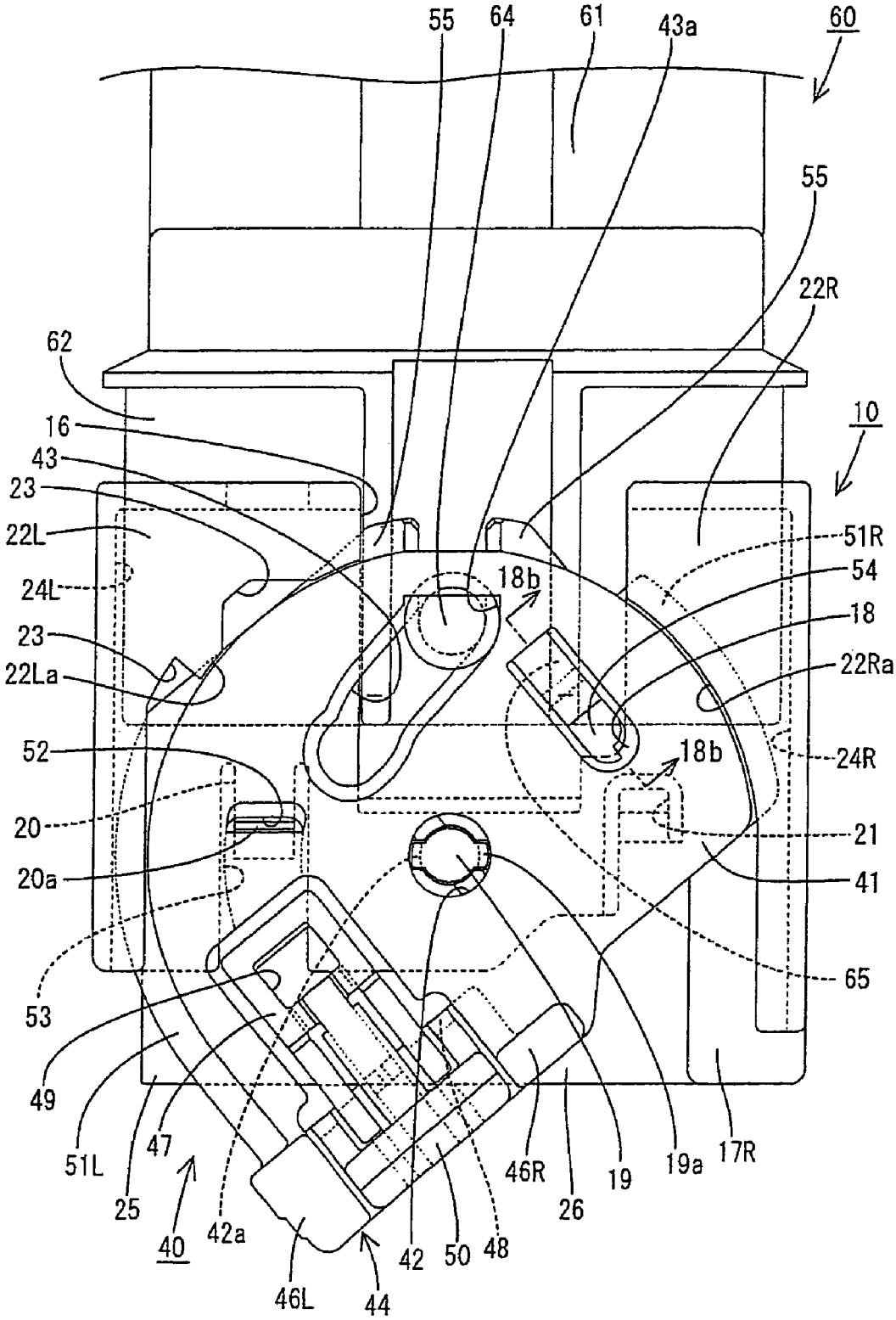
FIG. 4 is a plan view showing a cam follower at the entrance of a cam groove.
Figure 5:
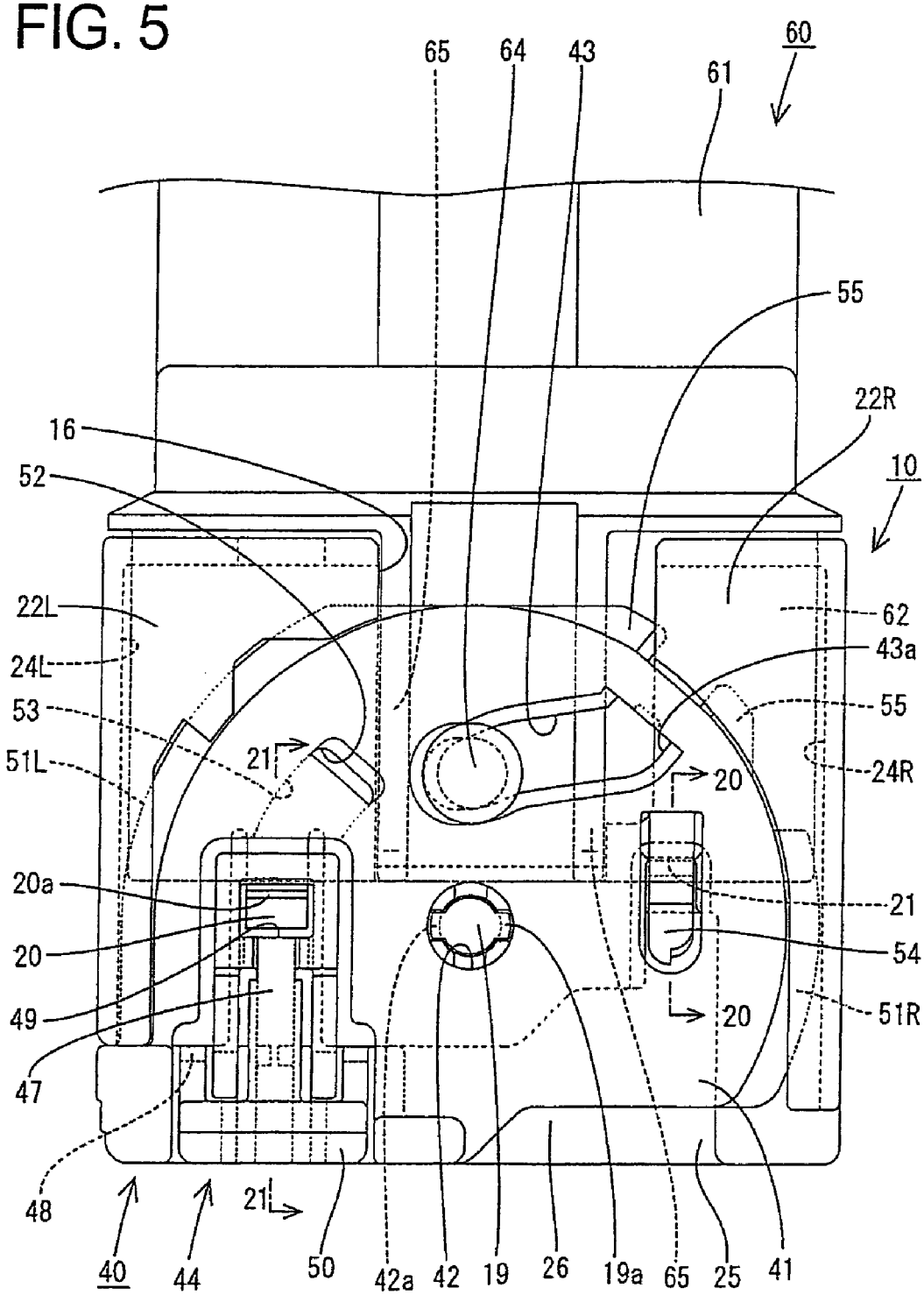
FIG. 5 is a plan view showing the two housings connected.
Figure 6:
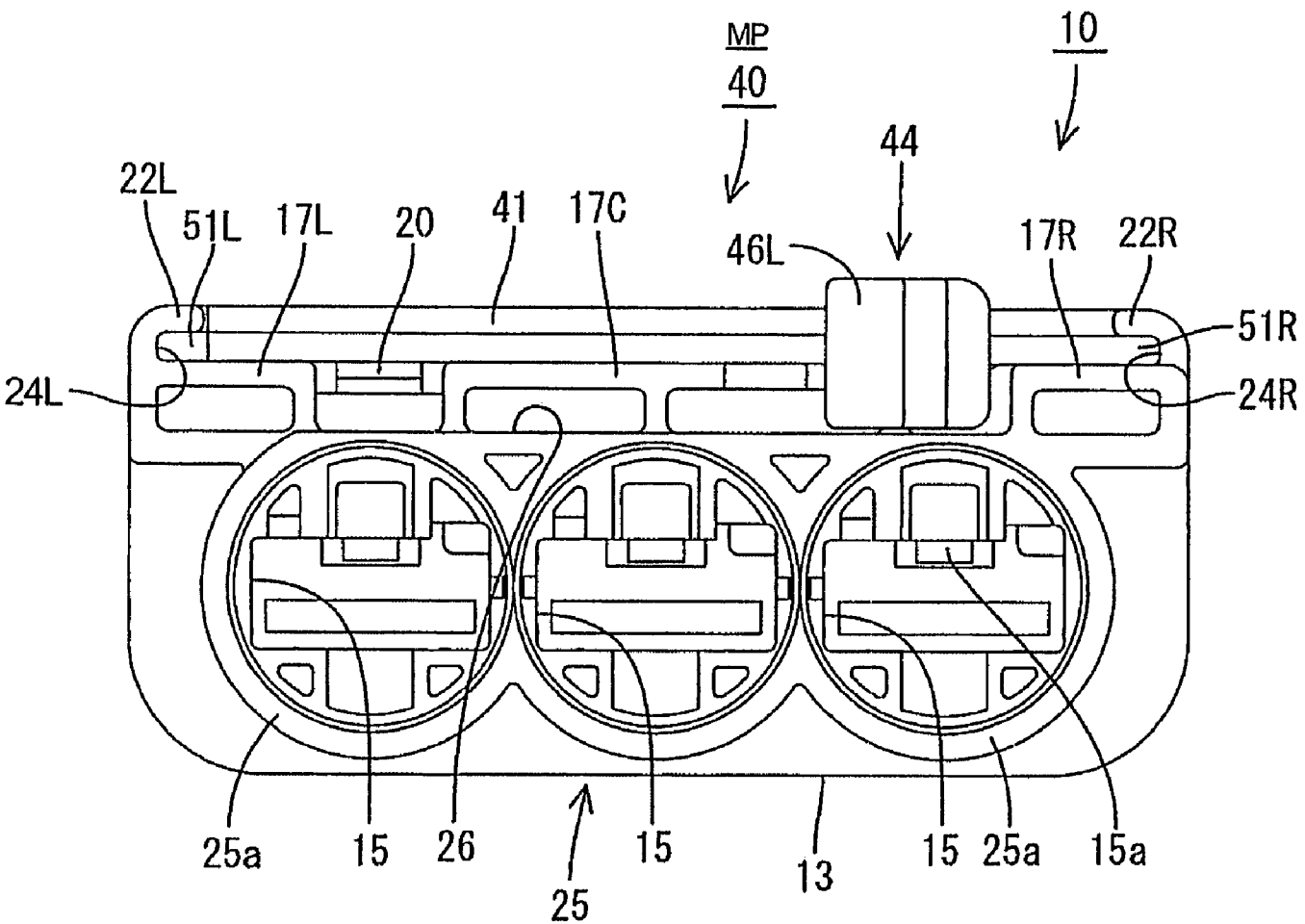
FIG. 6 is a rear view of the first housing with the lever at the mount position.
Figure 7:
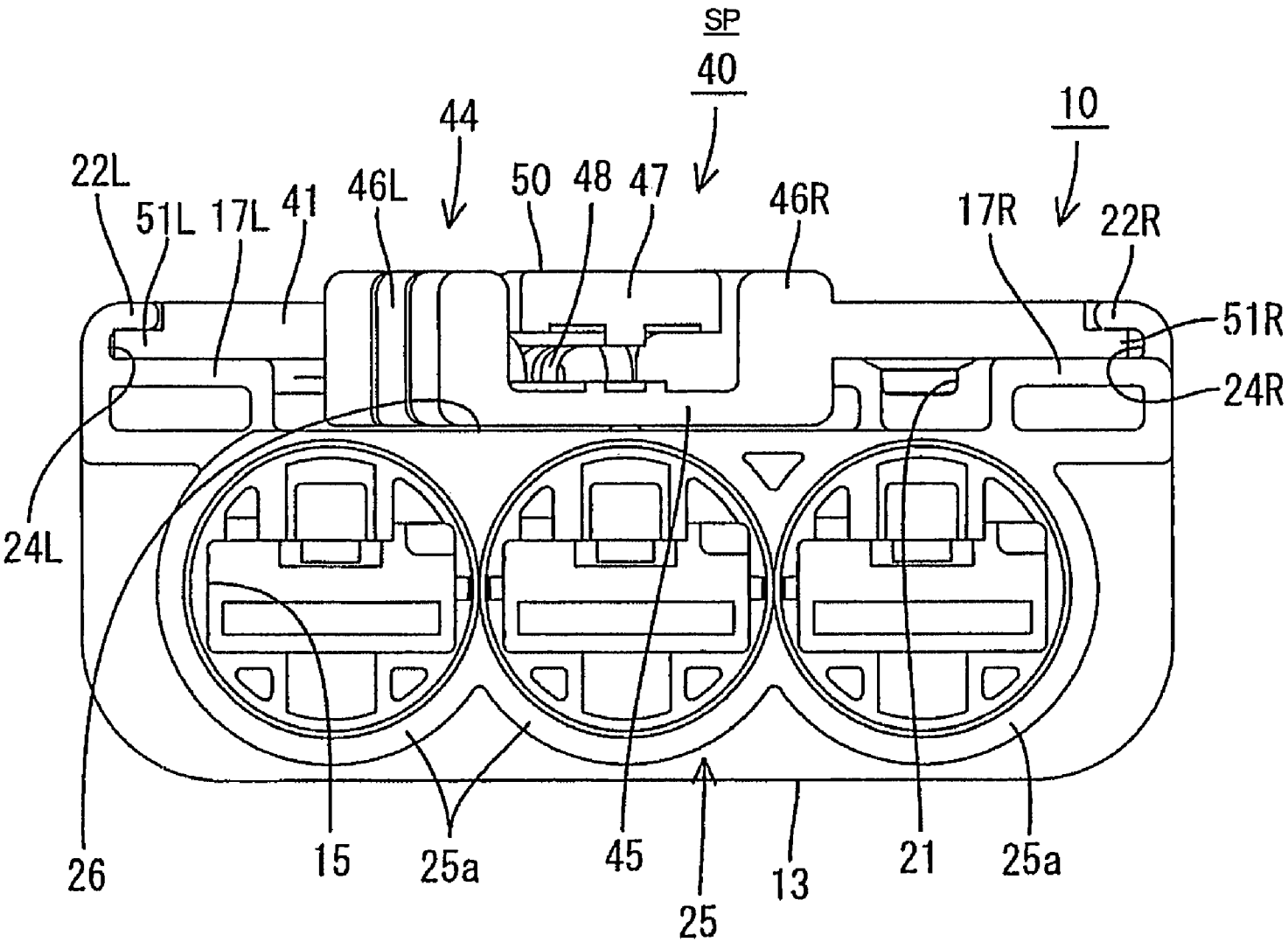
FIG. 7 is a rear view of the first housing showing the state where the lever is at the standby position.
Figure 8:
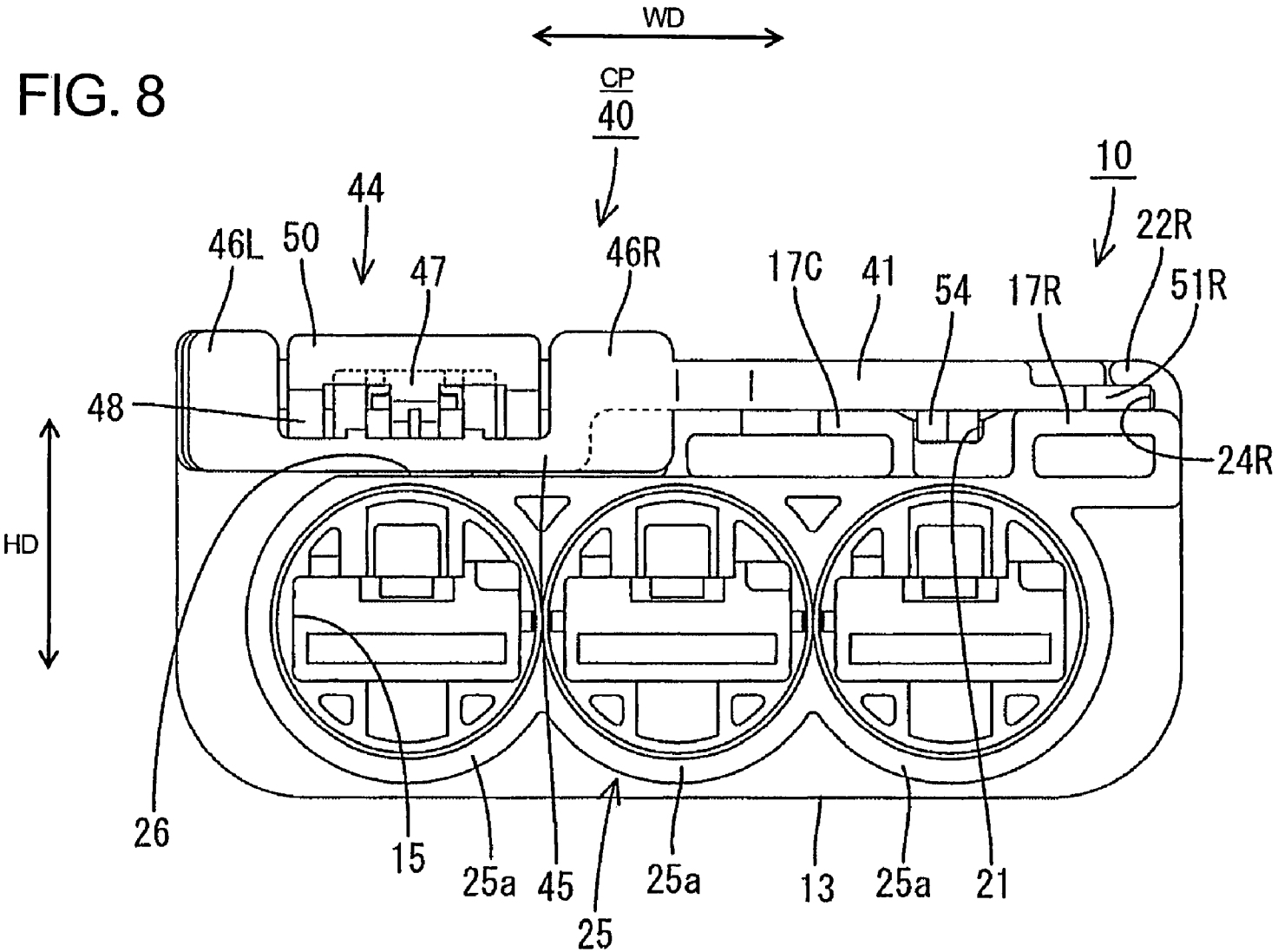
FIG. 8 is a rear view of the first housing showing the state where the lever is at the connection position.
Figure 9:
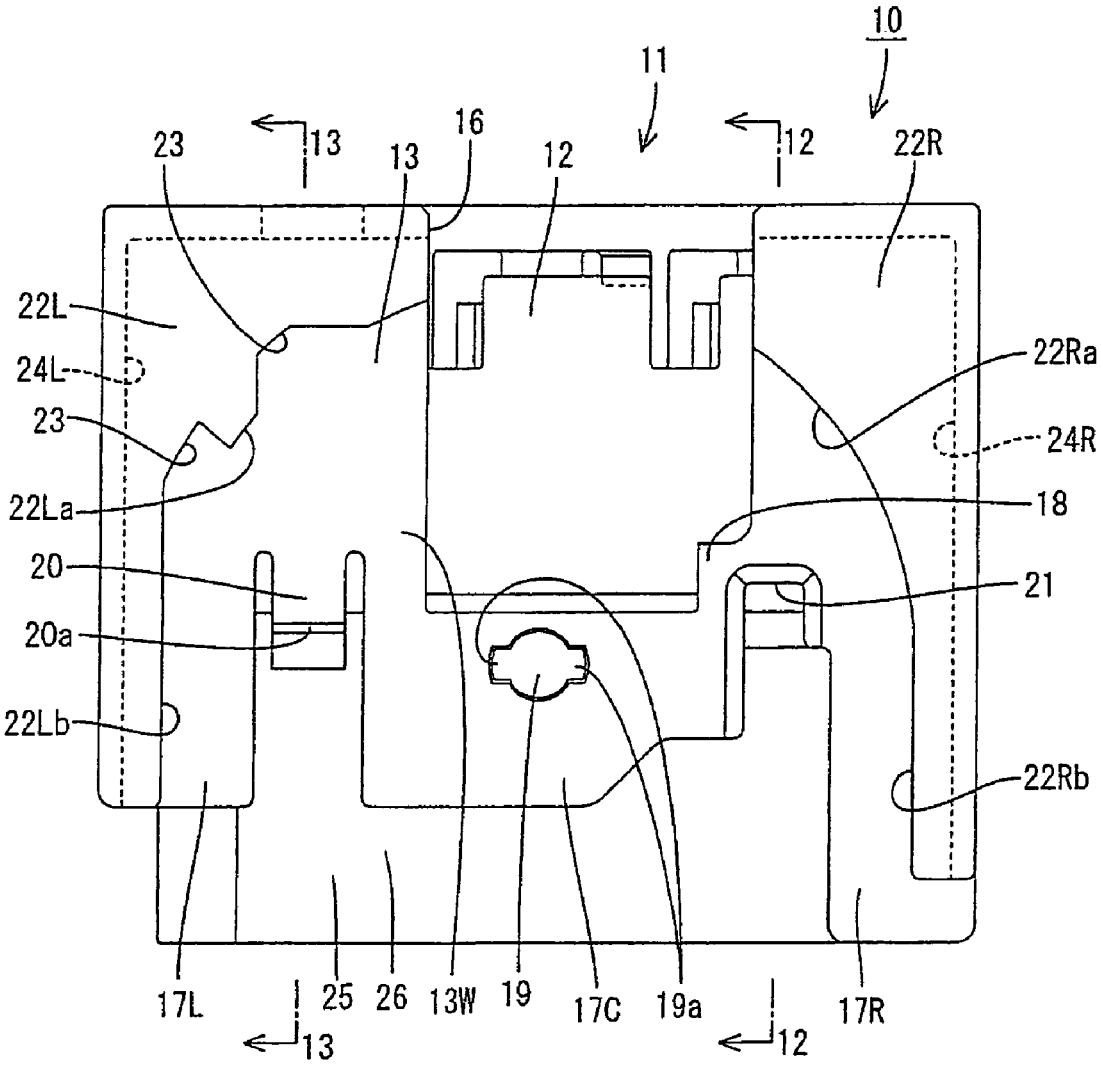
FIG. 9 is a plan view of the first housing.
Figure 10:
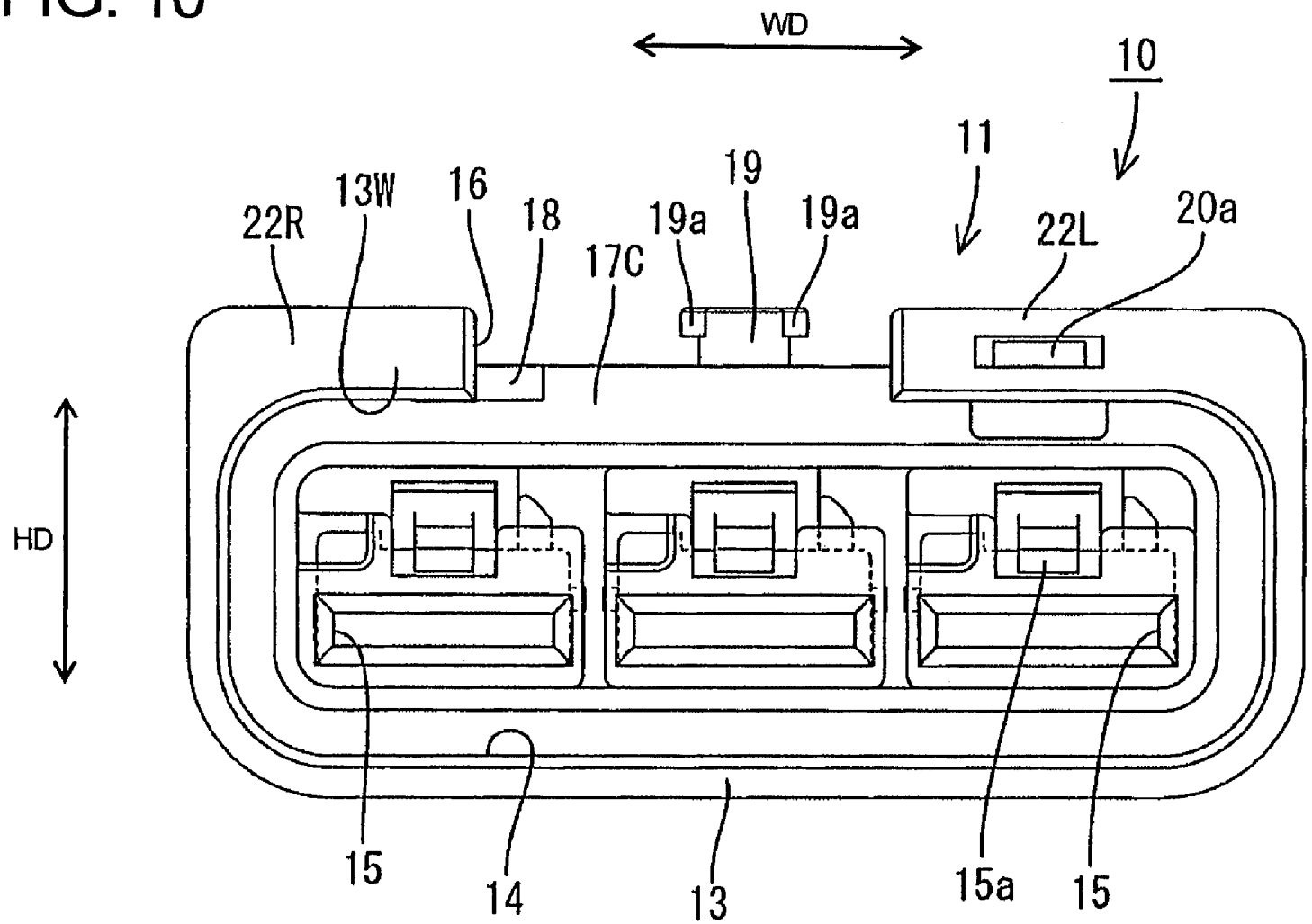
FIG. 10 is a front view of the first housing.
Figure 11:
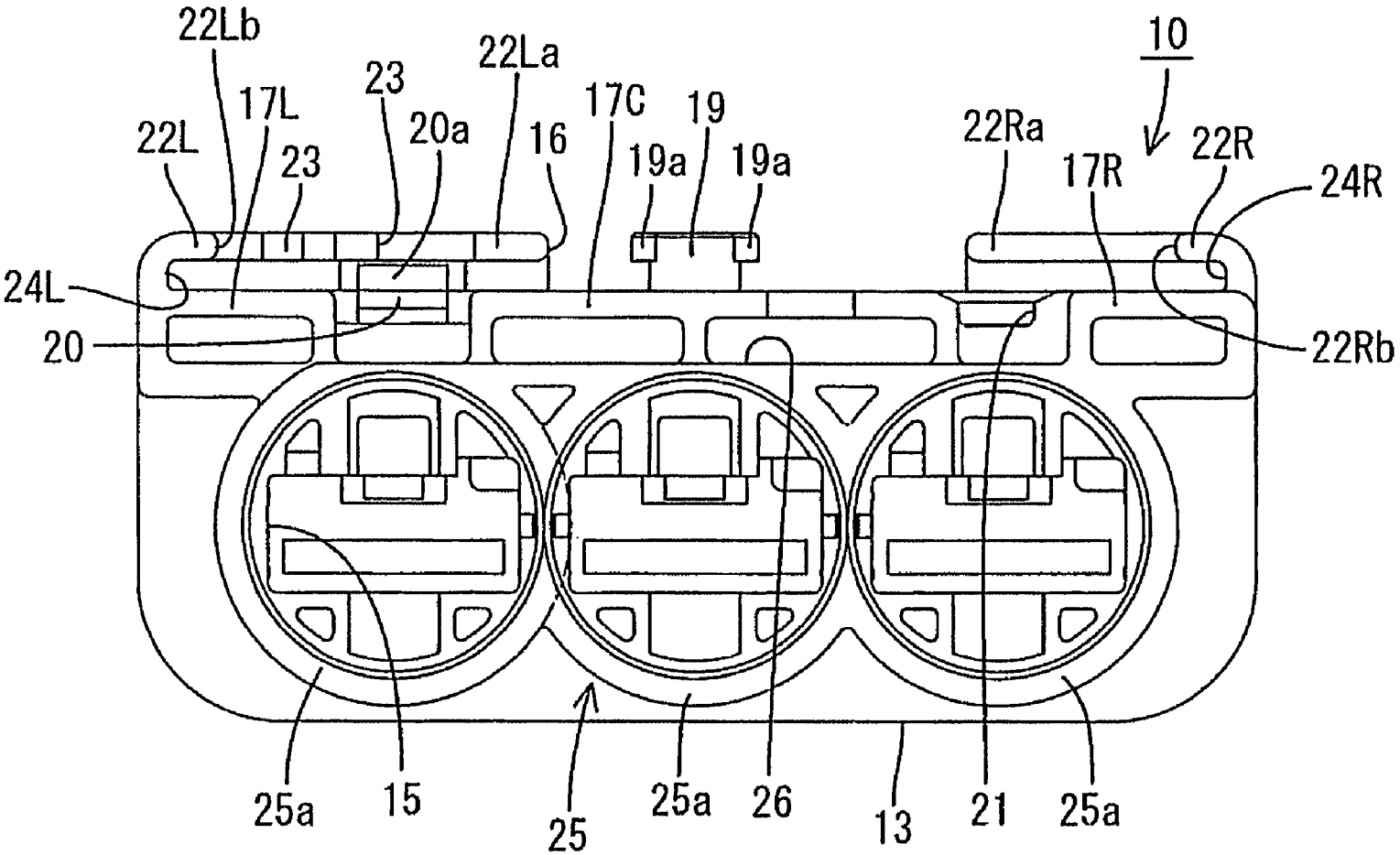
FIG. 11 is a rear view of the first housing.
Figure 12:
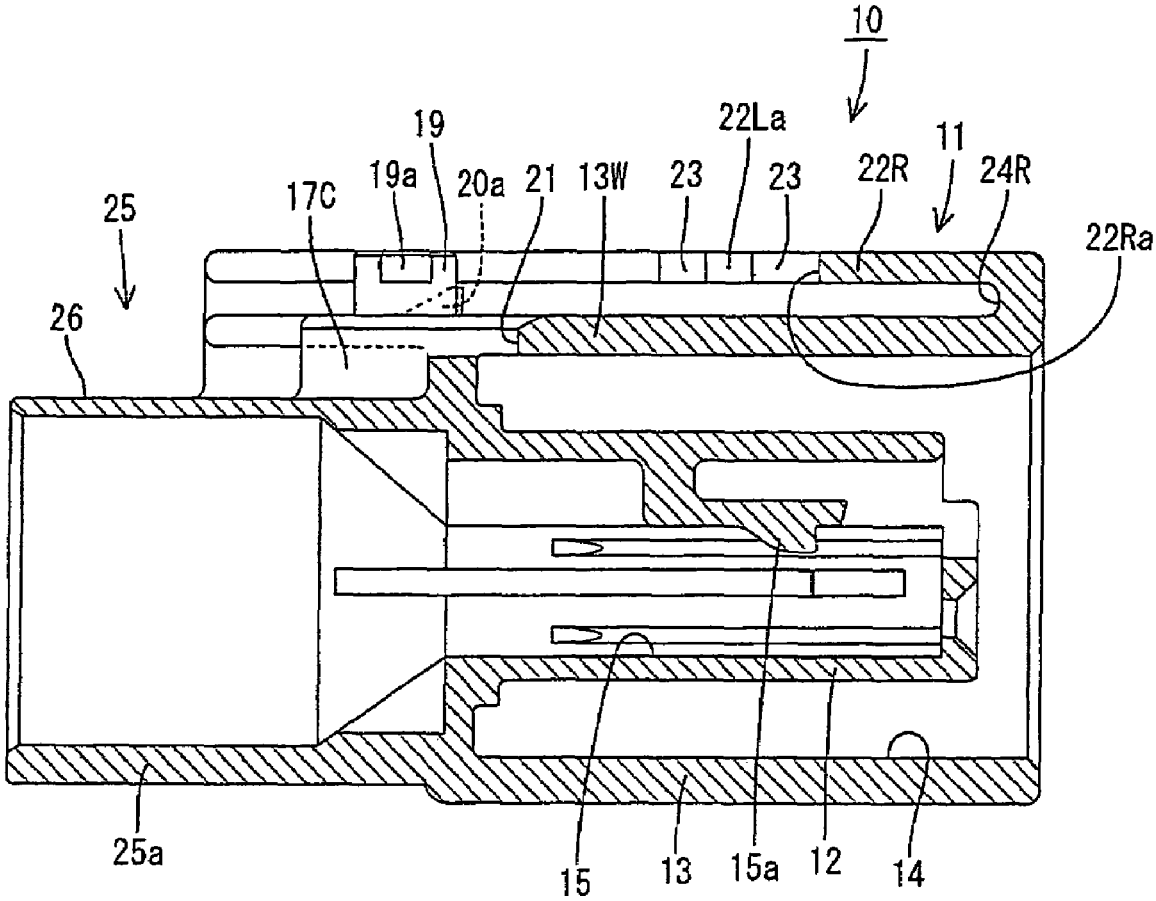
FIG. 12 is a section along 12—12 of FIG. 9.
Figure 13:
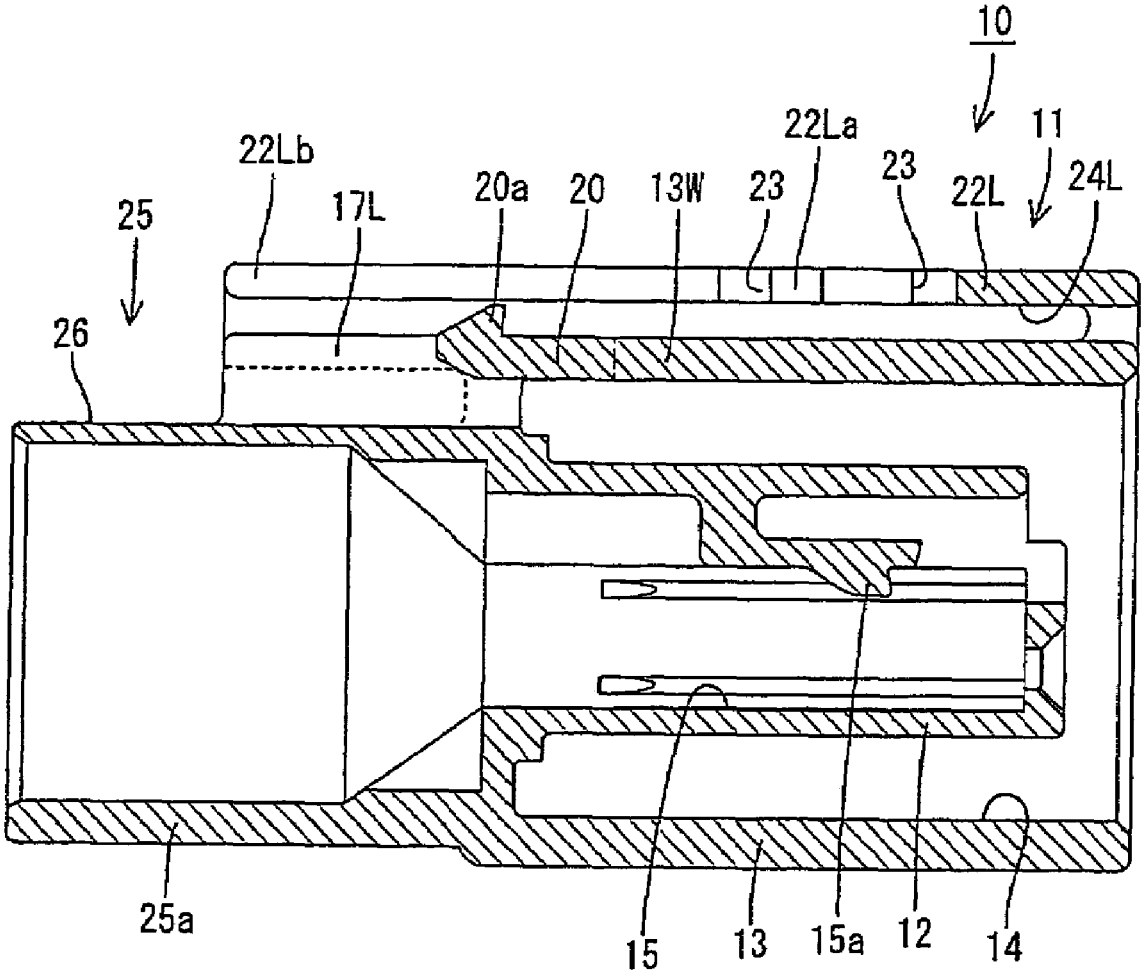
FIG. 13 is a section along 13—13 of FIG. 9.
Figure 14:
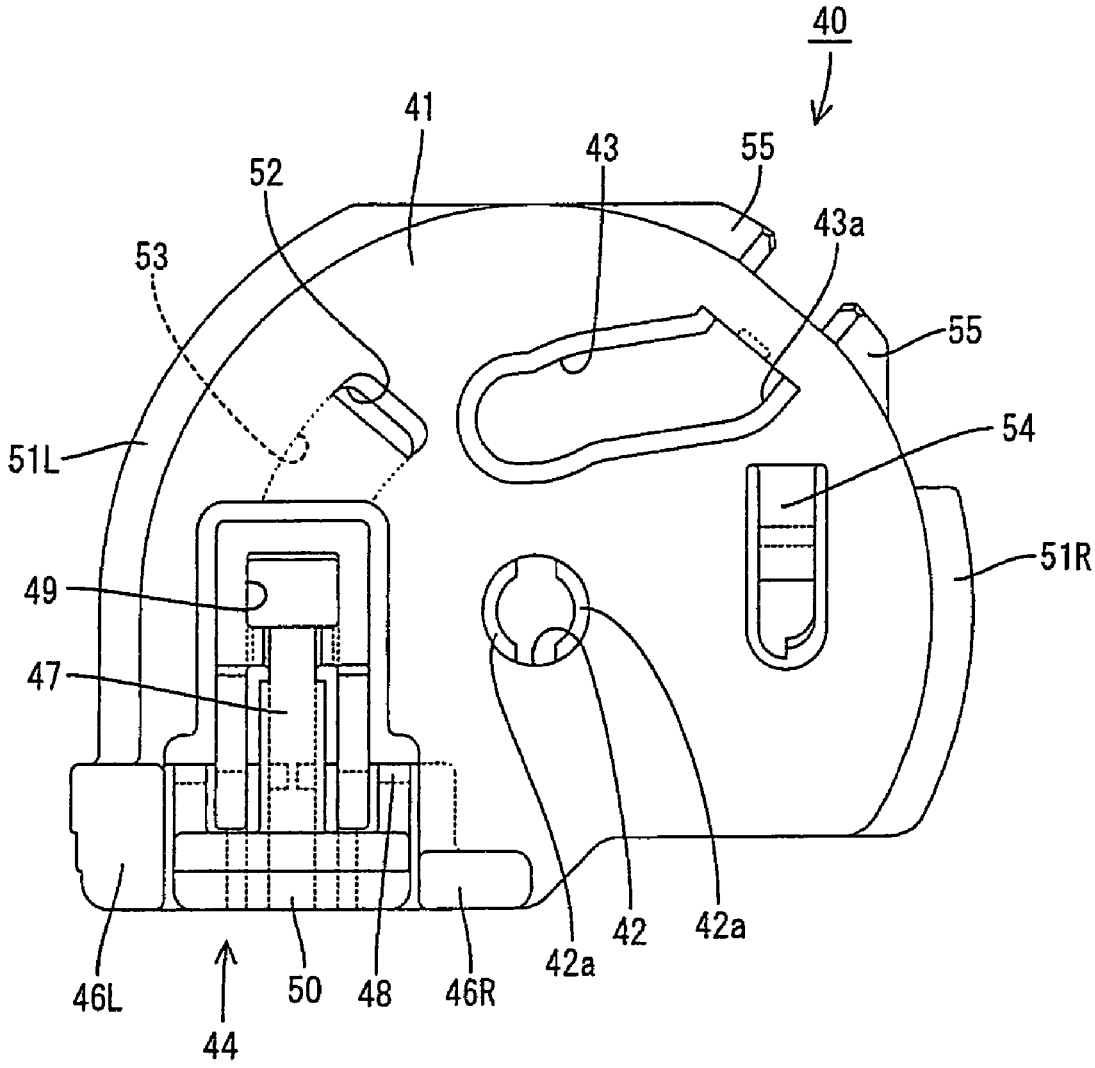
FIG. 14 is a plan view of the lever.
Figure 15:
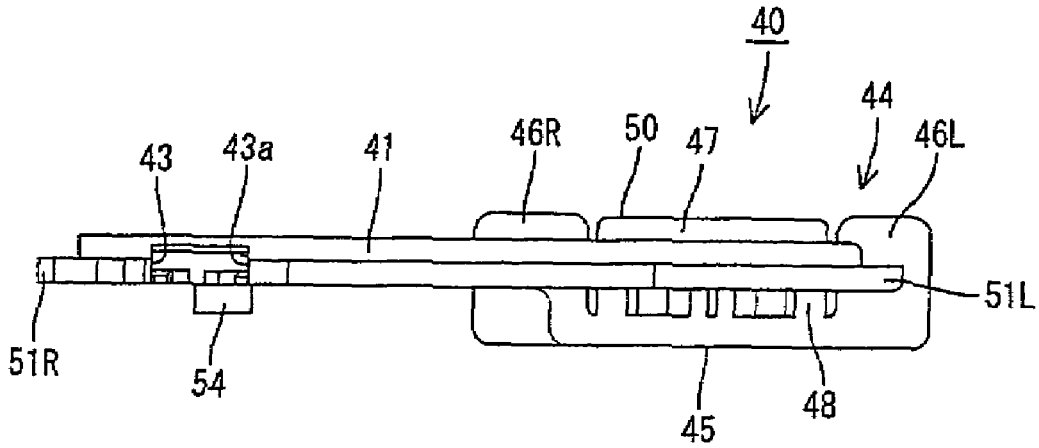
FIG. 15 is a front view of the lever.
Figure 16:
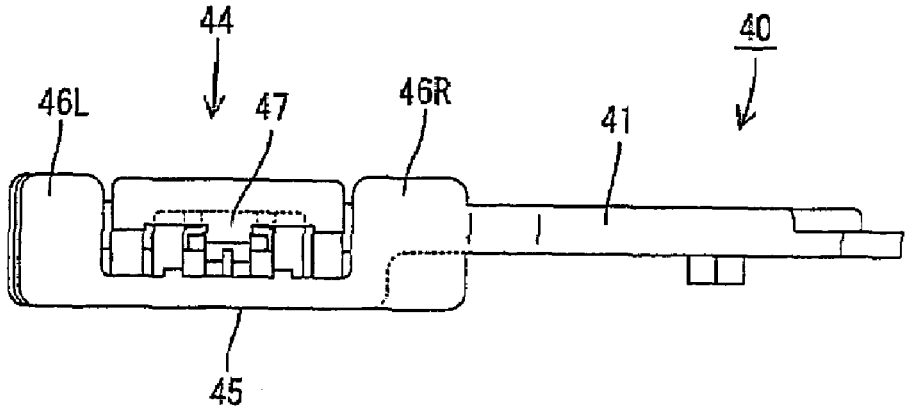
FIG. 16 is a rear view of the lever.
Figure 17:
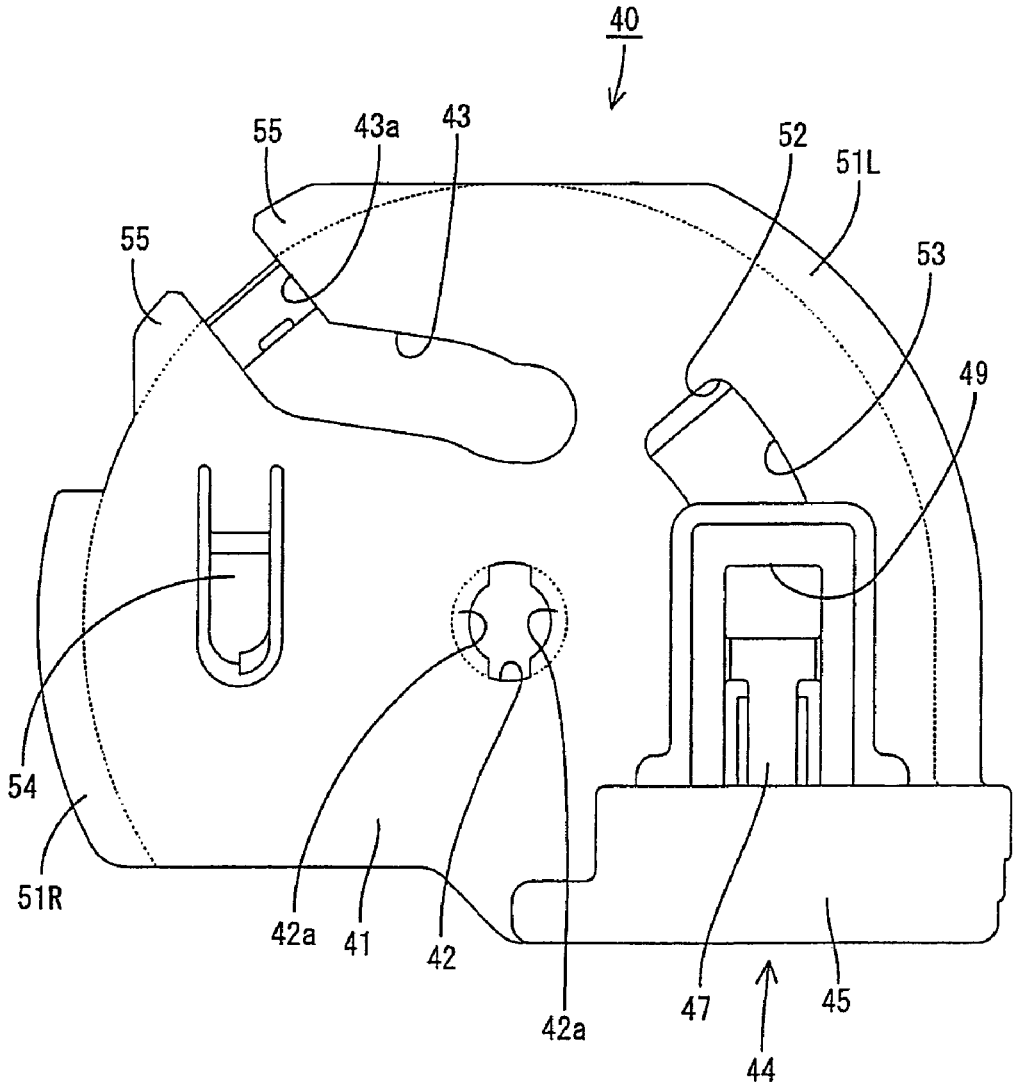
FIG. 17 is a bottom view of the lever.

The second housing 60 can be connected with the first housing 1.0 from the front when the lever 40 is in the standby position SP. More particularly, the receptacle 62 is fit lightly into the fitting recess 14. The cam follower 64 then passes a clearance between the guide projections 55 to enter the entrance 43*a* of the cam groove 43 as shown in FIG. 4, and the canceling ribs 65 having entered the notch 16 contact the lower surface of the resilient locking piece 54 to displace the resilient locking piece 54 up and out, as shown in FIG. 18(*b*). The interlocked state of the resiliently locking piece 54 and the receiving portion 18, i.e. the state preventing the rotation of the lever 40 from the standby position SP to the connection position CP is canceled by the displacement of the resilient locking piece 54.

The left finger placing portion 46L of the operable portion 44 can be pushed obliquely forward to the left e.g. by a finger. Thus, the lever 40 is displaced in the engagement direction to the connection position CP by rotating the operable portion 44 clockwise by about 45° about the support shaft 19. The second housing 60 is pulled into the first housing 10 by a cam action (force multiplying action) caused by the engagement of the cam groove 43 and the cam follower 64 as the lever 40 is rotated. The housings 10, 60 reach a properly connected state when the lever 40 reaches the connection position and the tabs 63*a* enters the rectangular tubes 31 to connect the male terminal fittings 63 and the female terminal fittings 30 electrically. Thus, the operation of the lever 40 connects the two housings 10, 60.

Figure 20:
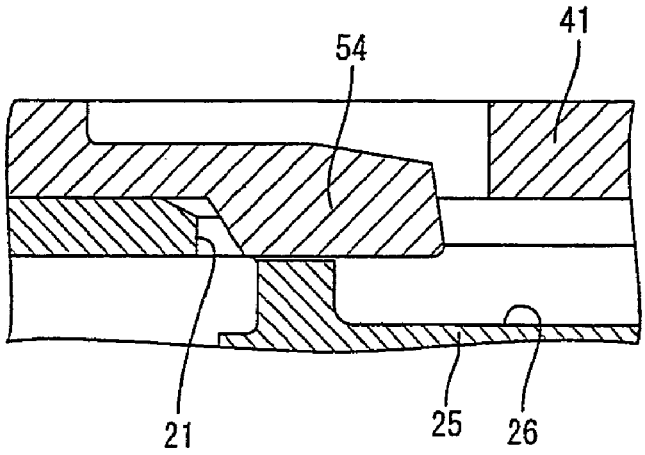
FIG. 20 is a section along 20—20 of FIG. 5.

In the process of rotating the lever 40, the resilient locking piece 54 is displaced obliquely back to the right in sliding contact with the upper surfaces of the canceling portions 65 and the receiving portion 18 while being resiliently displaced up and out. The resilient locking piece 54 is restored resiliently to enter the escaping recess 21 when the lever 40 reaches the connection position CP, as shown in FIG. 20. Further, the right bulge 51R is kept in the right guide groove 24R and the right guide projection 55 is fit in the right guide groove 24R. The left bulge 51L is kept in the left guide groove 24L. In this way, the peripheral edge of the lever 40 is prevented from separating up from the first housing 10 so that the lever 40 can be operated stably.

In the process of rotating the lever 40 to the connection position CP, the lock projection 20*a* moves towards the lock arm 47 in the escaping groove 53 while the flexible locking piece 20 undergoes no resilient displacement. The lock projection 20*a* and the front end of the lock arm 47 interfere with each other immediately before the lever 40 reaches the connection position CP. At this time, a downward or outward resilient displacement of the flexible locking piece 20 is prevented because the front end of the upper wall of the receptacle 62 that is fit into the fitting recess 14 contacts the flexible locking piece 20 from below. Accordingly, the front end of the lock arm 47 moves over the lock projection 20*a* while the lock arm 47 is resiliently displaced up.

Figure 3:
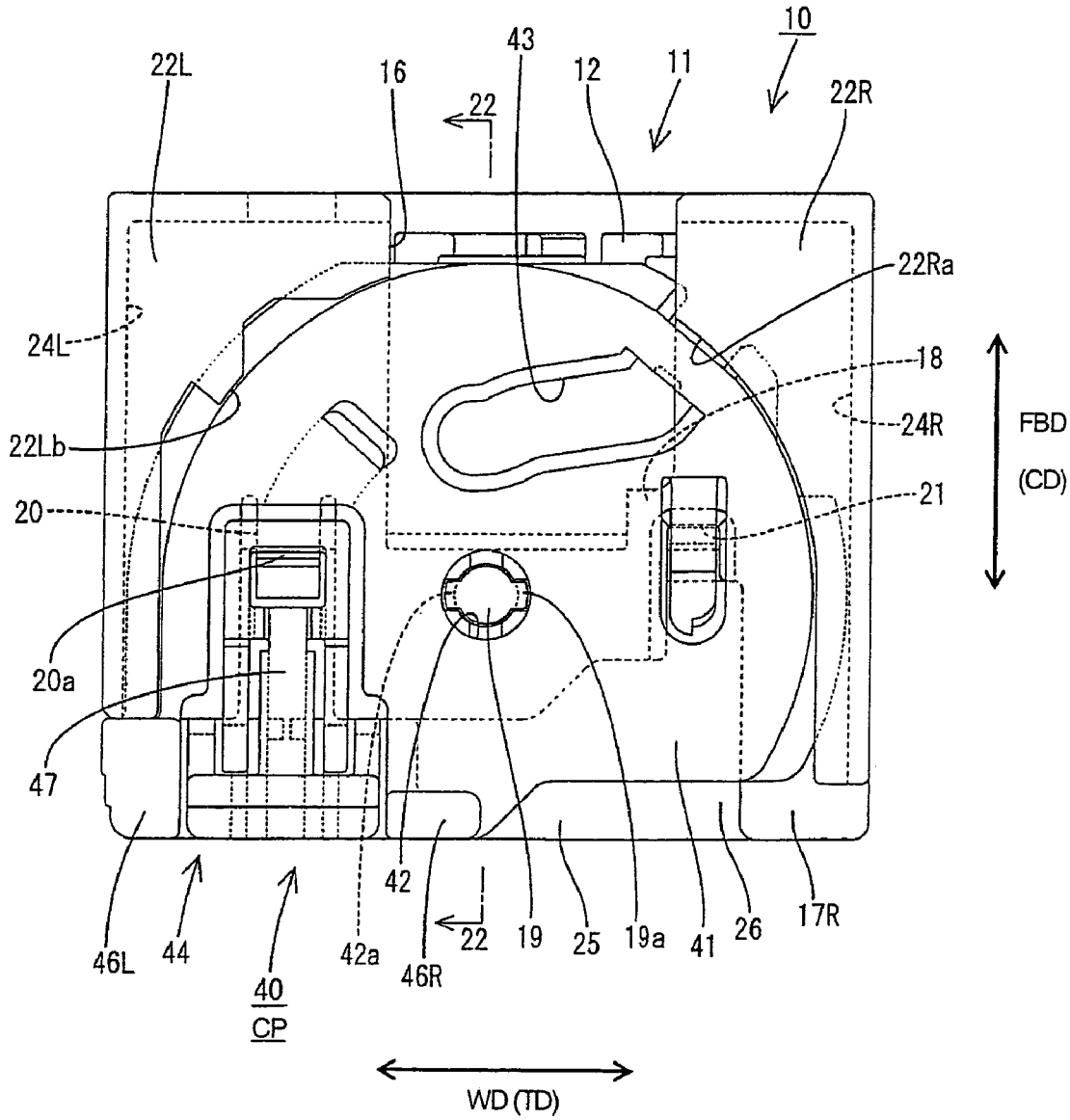
FIG. 3 is a plan view of the first housing showing the lever at a connection position.
Figure 21:
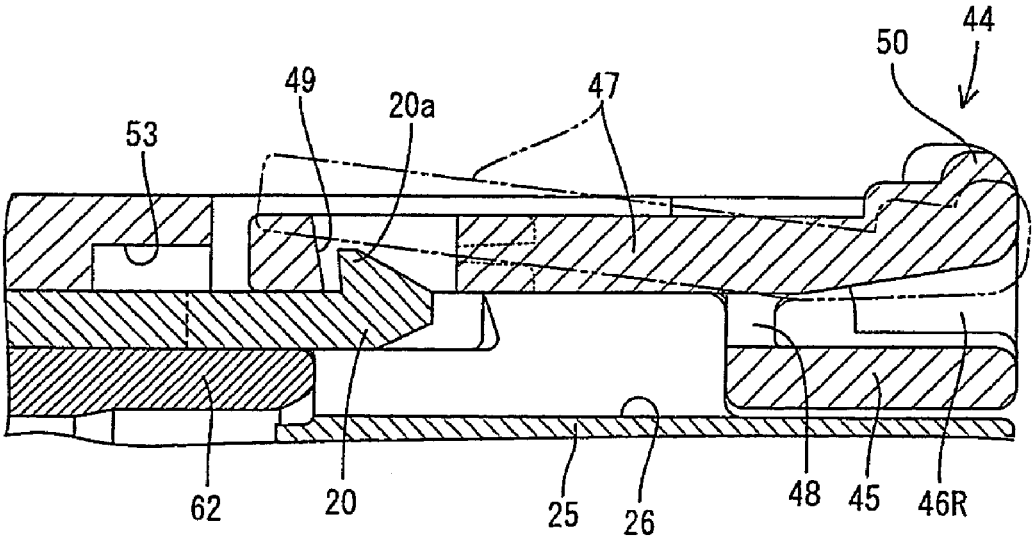
FIG. 21 is a section along 21—21 of FIG. 5.
Figure 22:
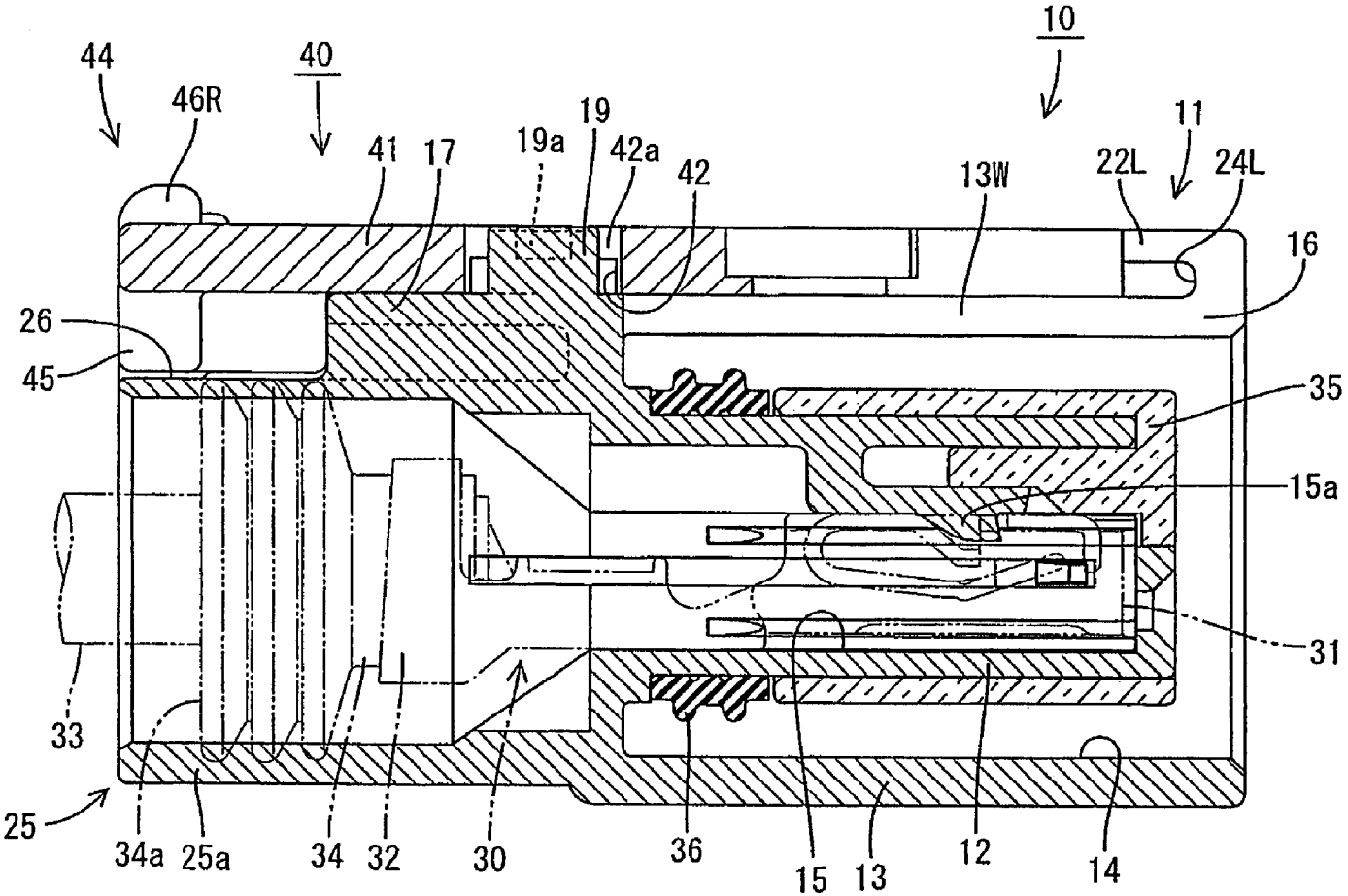
FIG. 22 is a section along 22—22 of FIG. 3.
Figure 23:
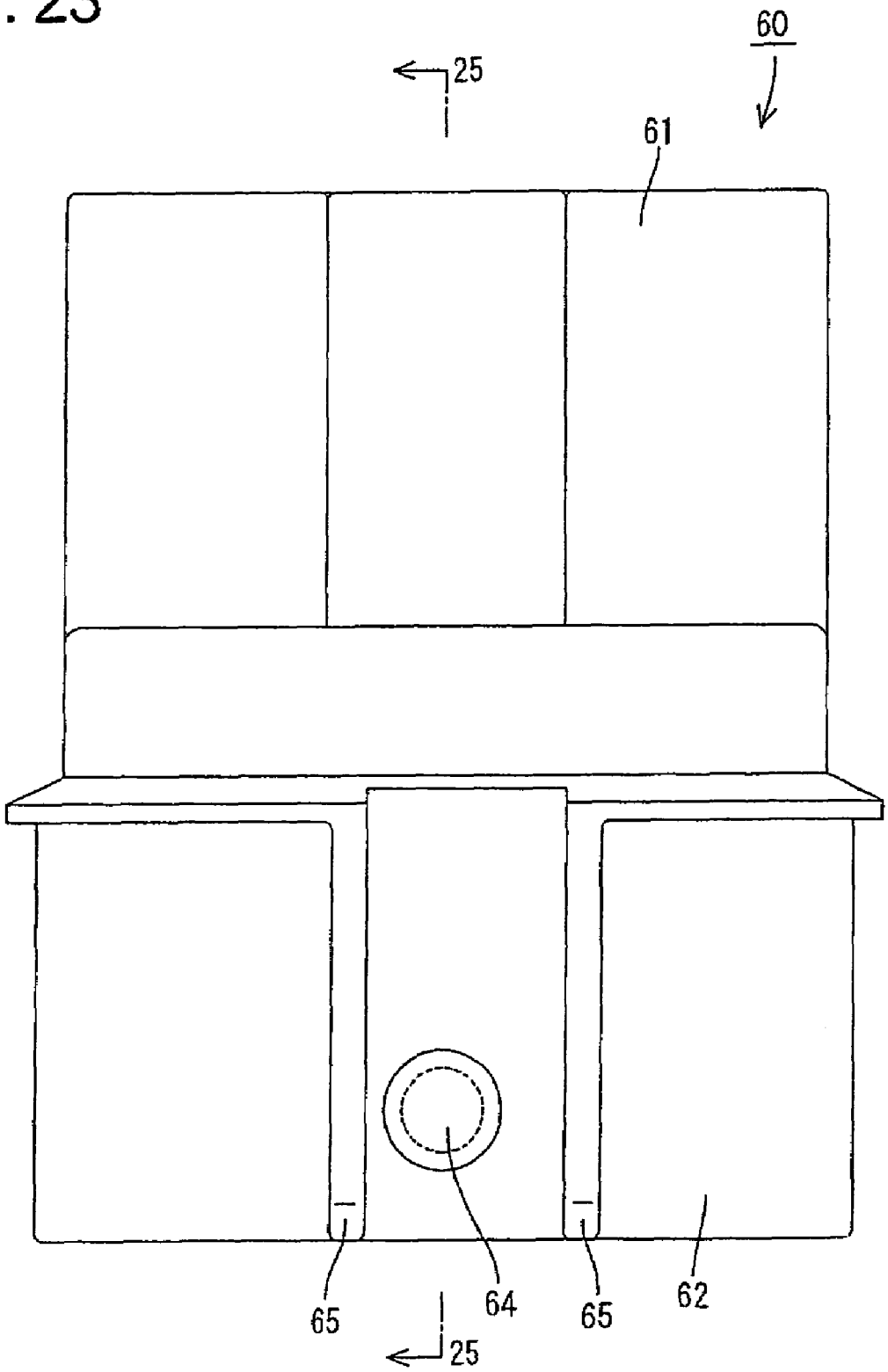
FIG. 23 is a plan view of a second housing.
Figure 24:
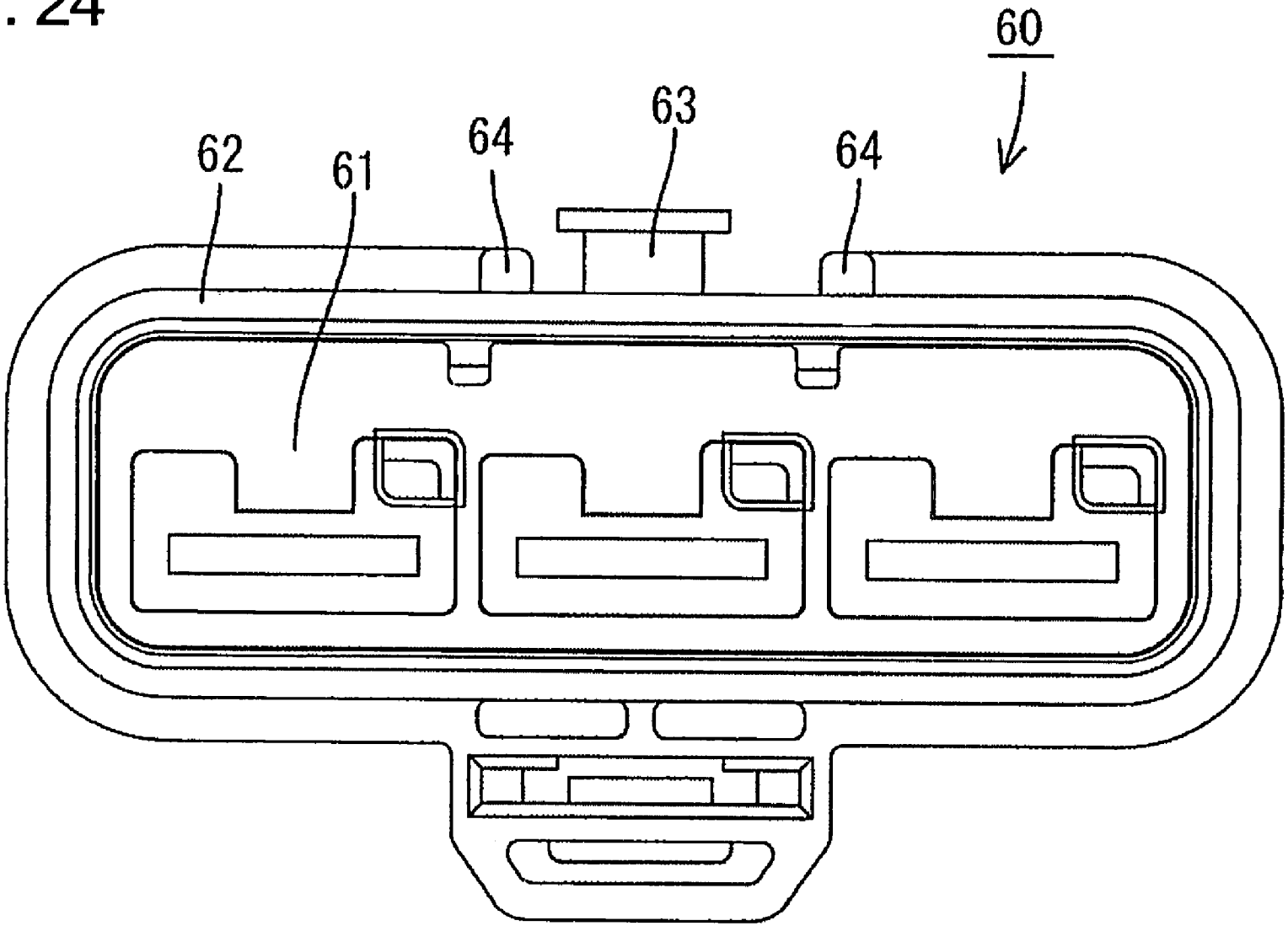
FIG. 24 is a front view of the second housing.
Figure 25:
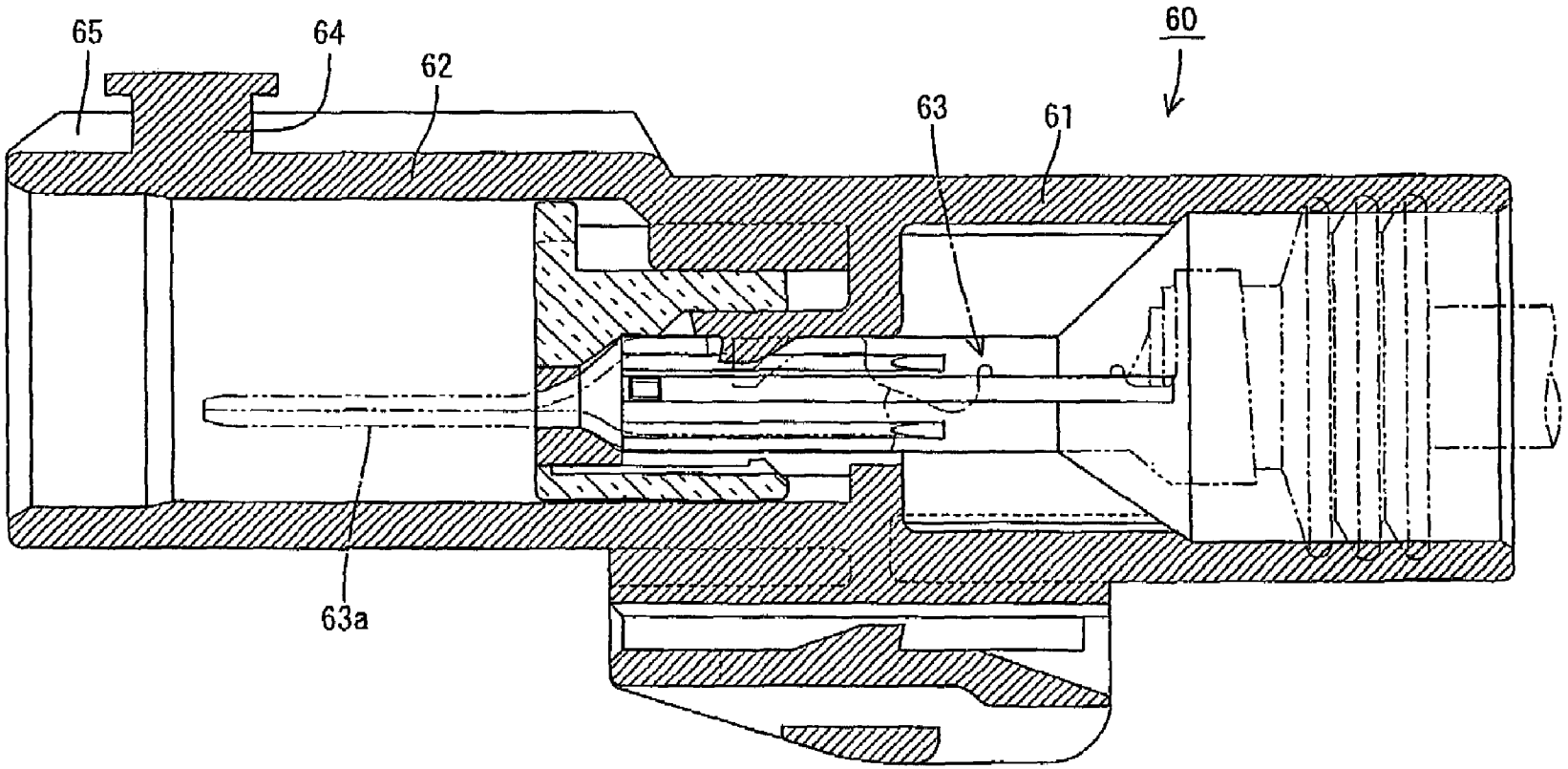
FIG. 25 is a section along 25—25 of FIG. 23.

The flexible locking piece 20 and the lock arm 47 deform resiliently to engage the lock projection 20*a* with the lock hole 49 when the lever 40 reaches the connection position CP, as shown in FIGS. 3 and 21. At this time, the edge of the lock hole 49 contacts the lock projection 20*a* in the counterclockwise direction to prevent the lever 40 at the connection position CP from returning back to the standby position SP. At this time, the lock projection 20*a* and the lock hole 49 are not disengaged inadvertently from each other since the flexible locking piece 20 is prevented from a downward resilient displacement by the contact of the receptacle 62 from below. Further, the left finger placing portion 46L and the corresponding left end of the support 45 engages the rear end surface of the left pedestal 17L in the clockwise direction. In this way, the lever 40 is locked at the connection position CP and is prevented from rotating in both forward and reverse directions. Similarly, with the lever 40 at the connection position CP, substantially the entire operable portion 44 is in the accommodation space 26 and the rear end surface of the operable portion 44 (supporting portion 45 and left and right finger placing portions 46L, 46R) is substantially flush with the rear end surface of the sealing tower 25 of the first housing 10.

To separate the two connected housings 10, 60, the finger contact portion 50 of the lock arm 47 is pressed down and in by a finger from outside or above. Thus, the lock arm 47 is displaced resiliently in a seesaw manner resiliently to disengage the lock hole 49 from the lock projection 20*a*, as shown in phantom in FIG. 21. Thus, the lever 40 is permitted to rotate in the returning direction and to the standby position SP. The cam action caused by the engagement of the cam follower 64 and the cam groove 43 pushes the second housing 60 forward relative to the first housing 10 as the lever 40 rotates. As a result, the two housings 10, 60 are separated.

As described above, since the flexible locking piece 20 on the first housing 10 is engageable with the lock arm 47 of the lever 40 to lock the lever 40 at the connection position CP. Thus, it is not necessary to provide the first housing 10 with a locking means for exclusive use in addition to the flexible locking piece 20. Accordingly, the shape of the first housing 10 can be simplified as compared to a case where the first housing is provided with both the return preventing means for exclusive use and the locking means for exclusive use.

The second housing 60 contacts the flexible locking piece 20 to prevent disengagement of the flexible locking piece 20 from the lock 47 when the housings 10, 60 are connected. Therefore, secure locking is achieved by the engagement of the flexible locking piece 20 and the lock arm 47.

The flexible locking piece 20 passes the return preventing portion 52 and deforms resiliently in the process of displacing the lever 40 from the mount position MP to the standby position SP. The flexible locking piece 20 restores resiliently and engages the return preventing portion 52 when the lever 40 reaches the standby position SP, thereby preventing the lever 40 from returning in the release direction from the standby position SP to the mount position MP. The first housing 10 and the lever 40 need not be relatively displaced to separate from each other in the process of displacing the lever 40 to the standby position SP, and hence connected portions of the first housing 10 and the lever 40 will not be wrenched due to relative displacements of the first housing 10 and the lever 40 in separating directions.

A U-shaped lever holds the housing between two opposed arms that are supported on the housing by shafts. The lever is mounted on the housing by widening the spacing between the arms for mounting onto the shafts. Thus, assembling operability is poor. Contrary to this, the lever 40 is substantially plate-shaped and extends along only one outer surface of the first housing. Thus, there is no need to resiliently deform the lever 40 for mounting and assembling operability is better.

In the process of causing the cam follower 64 to enter the cam groove 43, the canceling portions 65 of the second housing 60 resiliently deform the resilient locking piece 54 of the connection preventing means. Thus, the lever 40 can move to the connection position CP. It is otherwise impossible to cancel the prevented state by the connection preventing means, resulting in better operability.

In the process of displacing the lever 40, the bulges 51L, 51R fit into the guide grooves 24L, 24R to prevent the lever 40 from being displaced in separating direction from the first housing 10. Thus, the displacement of the lever 40 can be stabilized.

The lock arm 47 and the flexible locking piece 20 are provided near the engaged portion of the left bulge 51L and the left guide groove 24L. Thus, relative displacements of the lever 40 and the first housing 10 in separating directions are prevented securely by the engagement of the left bulge 51L and the left guide groove 24L near the lock arm 47 and the flexible locking piece 20. Therefore, the lock arm 47 and the flexible locking piece 20 are engaged stably and the lever 40 can be locked securely at the connection position CP.

The housing includes the terminal accommodating portion 11 and the sealing tower 25 that is shorter than the terminal accommodating portion 11. The sealing tower 25 is shifted down towards the side opposite the side that has the lever 40 to define the accommodation space 26 above the sealing tower 25. The thick operable portion 44 is accommodated in the accommodation space 26. With this construction, a larger height can be ensured for the accommodation space 26 as compared to a case where the sealing tower is at the same height as the terminal accommodating portion, and the height of the entire lever-type connector can be reduced by locating the upper surface of the operable portion 44 at a lower or inward position.

Further, the upper end area of the sealing tower 25 that faces the accommodation space 26 is thinner than the other areas. Thus, the position of the operable portion 44 can be lowered to realize the further reduction in the height of the entire lever-type connector.

With the lever 40 held at the connection position CP, the operable portion 44 is accommodated in the accommodation space 26 and the rear end surface of the operable portion 44 is substantially flush with the rear end surface of the first housing 10. Thus, there is no likelihood that external matter will interfere with the operable portion 44 e.g. from below and interference of external matter with the operable portion 44 cannot detach the lever 40 from the first housing 10.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The lever is substantially plate-shaped and rotatable along one surface of the housing in the foregoing embodiment.

However, the lever may be substantially U-shaped and rotatable along both surfaces of the housing.

The two housings are connected while the lever is rotated in the foregoing embodiment. However, the invention is also applicable to connectors in which two housings are connected while a movable member is moved linearly or along another path such as an elliptic, arcuate, polygonal path.

The housing has the flexible locking piece to prevent displacement of the lever from the standby position to the mount position in the foregoing embodiment. However, the lever may have the flexible locking piece.

The lever has the resilient locking piece to prevent displacement of the lever from the standby position to the connection position in the foregoing embodiment. However, the housing may have the resilient locking piece.

The locked state of the resilient locking piece for preventing displacement of the lever from the standby position to the connection position is canceled as the male housing is fit initially in the foregoing embodiment. However, the locked state of the resilient locking piece may be canceled separately from the initial fitting operation of the male housing.

The receptacle of the male housing prevents the flexible locking piece from displacing in a direction to disengage from the lock arm when the two housings are connected in the foregoing embodiment. However, the displacement of the flexible locking piece from the lock arm may be permitted when the two housings are connected.

Pressing portions of the housing press the bulges on the lever in the foregoing embodiment to prevent displacement of the lever from the housing in a separating direction. However, the lever need not have the bulges.

The center of axis of the sealing tower is shifted from the middle position of the housing with respect to thickness direction in the foregoing embodiment. However, it may be at the substantially same position as the middle of the housing with respect to thickness direction.

The means for preventing displacement of the lever from the standby position to the mount position is resiliently deformable in the foregoing embodiment. However, it may be a projection projecting from the housing or the lever that is not resiliently deformable according to the invention.

The means for preventing displacement of the lever from the connection position to the standby position is resiliently deformable in the foregoing embodiment. However, it may be a projection projecting from the housing or the lever that is not resiliently deformable.

The means for preventing the displacement of the lever from the standby position to the connection position is resiliently deformable in the foregoing embodiment. However, it may be a projection projecting from the housing or the lever that is not resiliently deformable.

The thickness of the wall of the sealing tower at the side where the lever is arranged is thinner than the wall at the side opposite the lever in the foregoing embodiment. However, this thickness may be substantially equal to or larger than the thickness of the wall at the side opposite the lever.

The rear end of the operable portion of the lever is substantially flush with the rear end of the housing when the two housings are connected in the foregoing embodiment. However, it may be before or behind the rear end surface of the housing.

The above-described means for preventing the lever from returning from the standby position to the mount position is the flexible locking piece, which is resiliently deformable, and the return preventing portion, which is not resiliently deformable. However, the return preventing portion may be resiliently deformable similar to the flexible locking piece.

Although the return preventing portion of the first housing is engaged with the locking means of the lever in the foregoing embodiment, the shape of the lever may be simplified by engaging the return preventing means of the lever with the locking means of the first housing.

The locking means of the first housing is the resiliently deformable lock arm in the foregoing embodiment. However, the locking means of the lever may be resiliently deformable.

The flexible locking piece is the means for preventing the lever from displacing from the standby position to the mount position and also serves as the means for preventing the lever from displacing from the connection position to the standby position in the foregoing embodiment. However, the means for preventing the lever from displacing from the standby position to the mount position and the means for preventing the lever from displacing from the connection position to the standby position may be separate.

What is claimed is:

1. A connector, comprising:

a housing;

a terminal accommodating portion for accommodating at least one terminal fitting;

a substantially tubular sealing tower for accommodating a resilient plug mounted on the rear of the terminal fitting, the sealing tower being shorter than the terminal accommodating portion;

a substantially plate-shaped movable member displaceably provided relative to the housing and extending substantially along only one surface of the housing, the movable member having an operable portion, wherein:

the sealing tower is offset from the terminal accommodating portion so that a center of an axis of the sealing tower is offset from a middle of the terminal accommodating portion with respect to a selected direction; and the operable portion is in an accommodation space substantially adjacent to the sealing tower and defined by the offset between the respective surfaces of the terminal accommodating portion and the sealing tower.

2. The connector of claim 1, wherein the operable portion is thicker than other parts of the movable member and is shaped to be on the respective surface of the housing as the movable member is displaced.

3. The connector of claim 2, wherein an upper end area of the sealing tower substantially facing the accommodation space is thinner than other areas.

4. The connector of claim 3, wherein an outer surface of the operable portion is substantially flush with or inward of the outer surface of the housing (10) when the movable member is at a connection position.

5. A connector assembly comprising the connector of claim 1 and a mating connector connectable therewith.

* * * * *